US005963766A

United States Patent [19]

Okuno et al.

[11] Patent Number: 5,963,766

[45] Date of Patent: Oct. 5, 1999

[54] DEVELOPING DEVICE

[75] Inventors: Yukihiko Okuno; Suguru Hamamichi, both of Toyokawa; Shinichi Yoshimoto, Aichi-Ken; Kentaro Katori; Mineyuki Sako, both of Toyokawa; Yoshihiro Shojo, Itami, all of Japan

[73] Assignee: Minolta Co., Ltd., Osaka, Japan

[21] Appl. No.: 09/092,876

[22] Filed: Jun. 8, 1998

[30] Foreign Application Priority Data

| | | | |
|---|---|---|---|
| Jun. 9, 1997 | [JP] | Japan | 9-150788 |
| Jul. 3, 1997 | [JP] | Japan | 9-178021 |
| Jul. 8, 1997 | [JP] | Japan | 9-182494 |
| Sep. 1, 1997 | [JP] | Japan | 9-236104 |

[51] Int. Cl.[6] ..... G03G 15/08

[52] U.S. Cl. ..... 399/256; 399/254

[58] Field of Search ..... 399/256, 254, 399/255, 257–260

[56] References Cited

U.S. PATENT DOCUMENTS

| | | | |
|---|---|---|---|
| 4,777,512 | 10/1988 | Takahashi et al. . | |
| 4,800,412 | 1/1989 | Ueda . | |
| 4,864,349 | 9/1989 | Ito . | |
| 4,894,688 | 1/1990 | Taniguchi et al. . | |
| 4,954,404 | 9/1990 | Inoue et al. | 430/45 |

FOREIGN PATENT DOCUMENTS

| | | |
|---|---|---|
| 05333691 | 12/1993 | Japan . |
| 06051634 | 2/1994 | Japan . |
| 06186841 | 7/1994 | Japan . |

*Primary Examiner*—Richard Moses
*Attorney, Agent, or Firm*—McDermott, Will & Emery

[57] ABSTRACT

A supply screw 10 and a collection screw 20 for a developing device equip with screw blades having different forms at particular sections so as to make conveying force of developer different depending on sections. Screw blades for big conveying force are attached within sections where developer distribution is dense while screw blades for small conveying force are attached within sections where developer distribution is sparse. In other words, conveying force is made to be greater at sparse-distribution section while smaller at dense-distribution section. Developer delivery is also promoted by providing different conveying force area within carry-up area where developer is carried up from a supply screw 10 to a collection screw 20 or vice versa. By making conveying force of each section different, developer is uniformly delivered to a developing roll 87 whether in width direction or in axial direction. Furthermore, developer circulation in a developing device becomes smooth.

38 Claims, 32 Drawing Sheets

DEVELOPING DEVICE

This application is based on applications Nos. 9-150788, 9-178021, 9-182494, and 9-236104 filed in Japan, the contents of which is hereby incorporated by reference.

BACKGROUND OF THE INVENTION

1. Field of the Invention

The present invention relates to a developing device for use in an image forming apparatus of the electrophotographic type such as a copying machine and a printer, and more particularly to a developing device which eliminates harmful influences such as uniformed distribution due to stagnation of developer, increase of driving torque and stress to developer, by arranging to smoothly circulate the developer.

2. Related Art

As an example of a conventional developing device, there is a developing device described in Japanese Patent Laid-Open Application No. 5-333691. This developing device is constructed such that two upper and lower augers (hereinafter, referred to as "screw") 82, 85 are arranged in parallel so that their conveying directions are opposite to each other as shown in FIG. 30. While the upper and lower screws cause the developer to be given and received between both screws 82 and 85 as shown by arrows c and d and to be circulated, the developer is supplied to a developer carrier (developing roll) 87 provided adjacent the screw 82 to develop an electrostatic latent image on a photosensitive member through the developer carrier. In this developing device, the upper screw 82 supplies developer to the developer carrier 87 while the lower screw 85 collects the developer from the developer carrier 87.

In the conventional developing device described above, however, developer is not always circulated smoothly. This is because there is a defect in delivery of developer between two screws, or inclination is likely to occur in the distribution of developer within the developing device.

First, the delivery of developer will be described. The cause of the defect in the delivery is as follows. The conveying force of developer by each screw acts in the axial direction of the screw, and there is no conveying force in the delivery direction. Accordingly, setting aside the place (from above to below) indicated by the arrow c in FIG. 30 in which an external force, which is called gravity, acts in a direction to assist the delivery, gravity acts in a direction to hinder the delivery (carry up) conversely in the place (from below to above) indicated by the arrow d, and the efficiency of the delivery is noticeably low. In other words, in the place indicated by the arrow d, the developer is pushed out from back and overflows upwardly to thereby be only delivered (carried up).

For this reason, developer easily stagnates particularly in the place indicated by the arrow d, and it is necessary to noticeably increase the driving torque of the lower screw 85 in order to prevent such stagnation. Also, the stress may be applied to the developer stagnating in the place indicated by the arrow d to cause deterioration such as adhesion. Particularly, non-black color developer for use in a color image forming apparatus is more susceptible to stress than black developer, easily agglomerates, its deterioration is accelerated, or the after-treatment agent added to the developer may be removed. This has been a factor for hindering a vertical developing device from being adopted for a tandem image forming apparatus for which miniaturization is strongly requested. In this respect, a horizontal developing device with two screws horizontally arranged is the same in that the screws have no conveying force in the delivery direction, and therefore, has basically the similar problem in both delivery places although there is no hindrance due to gravity.

Next, the ununiformed distribution of developer will be described. A circulation path for developer in a developing device of this sort forms, as shown in FIG. 31, substantially a quadrilateral by the upper screw 82 (supply) and the lower screw 85 (collection). However, all the developer transferred from the downstream end 85*b* of the screw 85 to the upstream end 82*a* of the screw 82 does not reach the downstream end 82*b* of the screw 82, but part of the developer is supplied to the developing roll 87 midway, and passes through a developing nip to be collected in the course of the screw 85. The path of this part is indicated by arrows e in FIG. 31. The delivery of developer to the developing roll 87 is performed substantially over the entire width of the screws 82 and 85. For this reason, the amount of developer conveyed by the screw 82 gradually decreases from the upstream end 82*a* toward the downstream end 82*b* (FIG. 32). On the other hand, the amount of developer conveyed by the screw 85 gradually increases from the upstream end 85*a* toward the downstream end 85*b* (FIG. 33). This causes inclination in the distribution of the developer within the developing device.

Because of the inclination in the developer, the depth at which the screw 82 or 85 is actually immersed in developer is not uniform. More specifically, the screw 82 is more deeply immersed in developer toward the upstream end while the screw 85 is more deeply immersed in developer toward the downstream end. Therefore, FIGS. 32 and 33 represent the depth of the developer. Such ununiformity in depth of developer causes ununiformity in the delivery of developer between the screws 82, 85 and the developing roll 87, and as a result, the density of an image formed differs depending on the width direction (axial direction) of the screws 82, 85.

As the measure, it is possible to relatively reduce the ununiformity by increasing the conveying speed of the screws 82, 85, or to lighten the ununiformity by providing a third screw between the screw and the developing roll 87 as disclosed in Japanese Patent Laid-Open Application No. 6-51634. In the case of relatively reducing the ununiformity by increasing the conveying speed of the screws 82, 85, however, it is necessary to further increase the conveying speed when the degree of the ununiformity is great. Therefore, it is necessary to control so as to increase the conveying speed in response to the amount of developer which passes through the developing nip. Since there is a limit to the increase in the conveying speed, it functions effectively only in an area where a small amount of developer passes through the developing nip. Also, in the case of reducing the ununiformity by providing a third screw between the screw and the developing roll 87, the structure of the developing device becomes complicated, and the number of parts also increases, causing the cost to be increased.

The present invention has been achieved in order to solve the above-described problem of the conventional developing device. The object is to provide a developing device which makes the delivery of developer within the developing device smooth, and lightens the ununiformed distribution of the developer.

SUMMARY OF THE INVENTION

A developing device according to a first aspect of the present invention performed in order to solve this problem has a first screw and a second screw which convey developer in the axial direction, and in at least one of the first screw and the second screw, a difference in conveying force of developer is provided between the upstream side and downstream side in the conveying direction in such a manner that the depth of developer within the screw becomes uniform irrespective of the position in the axial direction.

In a developing device of this aspect, developer is conveyed by the first screw and the second screw and is circulated within the developing device. This circulation also agitates the developer. The developer is supplied to the developing roll and is collected while it is being circulated within the developing device. An electrostatic latent image formed on an image carrier of an image forming apparatus is developed through the developing roll. In at least one of the first screw and the second screw, a difference in conveying force of developer is provided between the upstream side and downstream side in the conveying direction. Therefore, the depth of developer within the screw is uniform irrespective of the position in the conveying direction. The delivery of developer between the screw and the developing roll is uniform irrespective of the position in the axial direction (width direction). Accordingly, light and dark of an image are not caused in the axial direction of the screw. It is not necessary to excessively increase the conveying speed and to increase the number of parts.

In this respect, it is desirable that the screw conveying force continuously changes from the upstream side toward downstream side, but it may be stepwise. In the stepwise manner, it is desirable that the number of steps is large, but it may be two stages.

Usually, in a developing device of this sort, one of these two screws is a supply screw for supplying developer to the developing roll while conveying it in the axial direction while the other is a collection screw for conveying developer in the axial direction by collecting it from the developing roll. Accordingly, in the case of applying this to the supply screw, the conveying force of the developer on the upstream side in the conveying direction is caused to be greater than that on the downstream side. This is because it is necessary to make the flow velocity faster because the amount of developer is larger toward the upstream side in the supply screw. In contrast, in the case of applying this to the collection screw, the conveying force of the developer on the downstream side in the conveying direction is caused to be greater than that on the upstream side. This is because the amount of developer is larger toward the downstream side in the collection screw.

In order to provide a difference in conveying force between on downstream side and on upstream side of one screw, for example, the effective convey area of the screw blades on the downstream side can be made different from that on the upstream side. More specifically, for the place (upstream side in the supply screw, downstream side in the collection screw) with a great conveying force, a screw blade with a large effective convey area is used, while for the place (downstream side in the supply screw, upstream side in the collection screw) with a small conveying force, a screw blade with a small effective convey area is used. As the concrete method, there are size (large and small) of the outer diameter, size (large and small) of the center angle, size (small and large) of inner diameter (shaft diameter), presence and absence of notch, and the like.

As other techniques for providing a difference in conveying force, there are a method of changing the pitch of the screw blade or the number of threads, a method of providing a member for hindering the conveyance of developer in the place with a small conveying force, and the like.

A developing device according to another aspect of the present invention is constructed such that it has first conveying means and second conveying means which convey developer, and that in a delivery area in which developer is delivered from one of the first conveying means and the second conveying means to the other, the conveying force of the conveying means on the receiving side is made greater than that on the giving side.

In a developing device according to this aspect, since the conveying means on the receiving side has a greater conveying force (the maximum amount of developer which can be conveyed per unit time) than the conveying means on the giving side in the delivery area, the conveying means on the receiving side is actually in a negative pressure state. For this reason, the developer, which has been conveyed by the conveying means on the giving side to reach the delivery area, is sucked in by the negative pressure at the conveying means on the receiving side so that it smoothly moves from the giving side to the receiving side. Therefore, the developer does not stagnate in the delivery area, but driving resistance of the conveying means does not increase, nor is any excessive stress applied to the developer. This restrains the driving force required for the conveying means from becoming excessive or deterioration (adhesion, etc. ) of the developer. Generally, one of the first conveying means and the second conveying means is a supply screw for supplying developer to the developing roll while conveying it, while the other is a collection screw for collecting developer from the developing roll to convey it.

In order to provide a difference in conveying force between receiving side and giving side, for example, the rotating speed of the conveying means can be made different between the two. More specifically, the rotating speed of the conveying means on the receiving side can be made faster than that on the giving side. As another method, the effective convey area of the screw blades within the delivery area can be made different between the two, or the number of threads or the pitch can be made different, or the screw blades of the conveying means on the giving side within the delivery area can be made parallel with the shaft, further no screw blades can be provided for the conveying means on the giving side within the delivery area.

This aspect is also applicable to a triaxial developing device having a collection screw, a supply screw and an agitation screw. In this case, it is applicable to both a first delivery area from the collection screw to the supply screw, and a second delivery area from the supply screw to the agitation screw. Further in this case, the first delivery area is preferably arranged downstream of the collection screw in the conveying direction as compared with the second delivery area. This is because if reversely arranged, developer may be concentrated on the supply screw in the first delivery area to hinder the delivery.

A developing device according to a further aspect of the present invention is constructed such that it has a first screw and a second screw which convey developer in the axial direction, that there is provided a delivery area in which developer is delivered from one of the first screw and the second screw to the other, and that in at least a portion within the delivery area of at least one of the first screw and the second screw, there is provided a large-diameter portion whose screw diameter is larger than the other portions.

In a developing device according to this aspect, there is provided a large-diameter portion in the first screw or the second screw within the delivery area, whereby the interval between the first screw and the second screw is short (screw blades of the first and second screws may be arranged so that they enter each other). Therefore, the developer is smoothly delivered from the giving side to the receiving side. For this reason, the developer does not stagnate in the delivery area, and therefore, each screw (particularly the giving-side screw) can be driven by small driving torque because of their low rotating resistance. Also, no stress is applied either to the developer within the delivery area. It is more preferable that a large-diameter portion each is provided for both the first screw and the second screw and large-diameter portions for both are overlapped in the axial direction.

A developing device according to another aspect of the present invention is constructed such that it has a developer storage tank, and a first screw and a second screw, provided within the developer storage tank, for conveying developer, that a delivery area, in which developer is delivered from one of the first and second screws to the other, is provided downstream of the giving-side screw in the conveying direction, and that the inner surface of the developer storage tank in the delivery area is curved-surface shaped or tapered.

In a developing device according to this aspect, when it is conveyed by the giving-side screw to reach the delivery area, the developer is naturally pushed out toward the receiving-side screw because the inner surface of the developer storage tank for that portion is curver-surface shaped or tapered. This causes the delivery of the developer in the delivery area to be smoothly made. Accordingly, stagnation of the developer in the delivery area, application of stress, and driving torque required for the first and second screws being excessively great can be prevented.

A developing device according to an additional aspect of the present invention is constructed such that it has a developer storage tank, and a first screw and a second screw, provided within the developer storage tank, for conveying developer, that a delivery area, in which developer is delivered from one of the first and second screws to the other, is provided downstream of the giving-side screw in the conveying direction, and that the conveying force of the giving-side screw is made smaller than that of the other portion in the delivery area.

In a developing device according to this aspect, since the conveying force by the giving-side screw in the conveying direction is smaller than in the other portions within the delivery area, an increase in stress of developer in that portion is effectively prevented. Accordingly, stagnation of developer in the delivery area, application of stress, and driving torque required for the first and second screws being excessively great can be prevented. In order to reduce the conveying force in the portion, the outer diameter can be made smaller among others to thereby reduce the effective convey area of the screw blades for the portion.

The invention according to each of these aspects has significant effect when it is applied to a vertical developing device in which the second screw is arranged above the first screw. In a carry-up area in which developer is carried up from the lower first screw to the upper second screw, gravity acts in a direction to hinder the delivery of developer and it is difficult to secure smooth circulation of developer. When the present invention is applied to this point, it becomes possible to smoothly circulate the developer.

DETAILED DESCRIPTION OF PREFERRED EMBODIMENTS

Hereinafter, with reference to the accompanying drawings, the detailed description will be made of embodiments embodying the present invention.

First Embodiment

First, the outline of an entire developing device according to this embodiment will be described. This embodiment is applicable to a vertical developing device shown in FIG. 1 and a horizontal developing device shown in FIG. 2. The vertical developing device can be suitably used in developer units for image forming units for each color in a tandem full color image forming apparatus.

Figure 1:
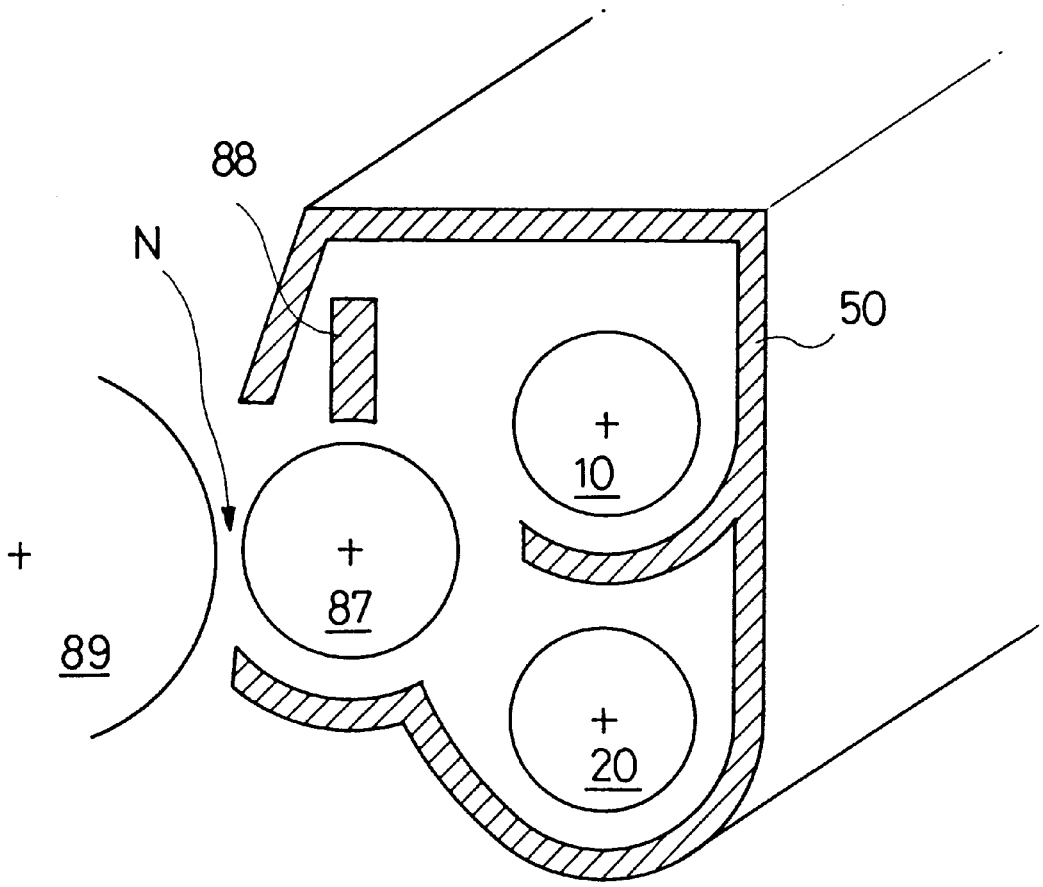
FIG. 1 is a view schematically showing the structure of a vertical developing device.

The vertical developing device of FIG. 1 is constructed such that two screws, that is, a supply screw (auger) 10 and a collection screw 20, and a developing roll 87 are arranged in parallel within a developing tank 50 which constitutes the outer frame. The two screws are arranged up and down. More specifically, the supply screw 10 is on the upper side while the collection screw 20 is on the lower side. The developing roll 87 partially projects from the developing tank 50, and its projecting portion is positioned close to a photosensitive drum 89 provided in the image forming apparatus body. Its closest place N is called developing nip. The photosensitive drum 89 and the developing roll 87 are in parallel as a matter of course. In this respect, the developing roll 87 is additionally provided with a regulating plate 88 for regulating the coverage of developer.

The supply screw 10 or the collection screw 20 is a rotatable shaft mounted with a large number of screw blades in such a manner that a conveying force in the axial direction is imparted to developer when the shaft rotates, although the detail will be described later. However, the supply screw 10 and the collection screw 20 are opposite to each other in the direction of conveyance and are used to circulate developer within the developing tank 50. The upper supply screw 10 serves to supply developer to the developing roll 87 while conveying it. Also, the lower collection screw 20 serves to collect the developer, which has passed through the developing nip N, from the developing roll 87 to circulate it again.

Figure 2:
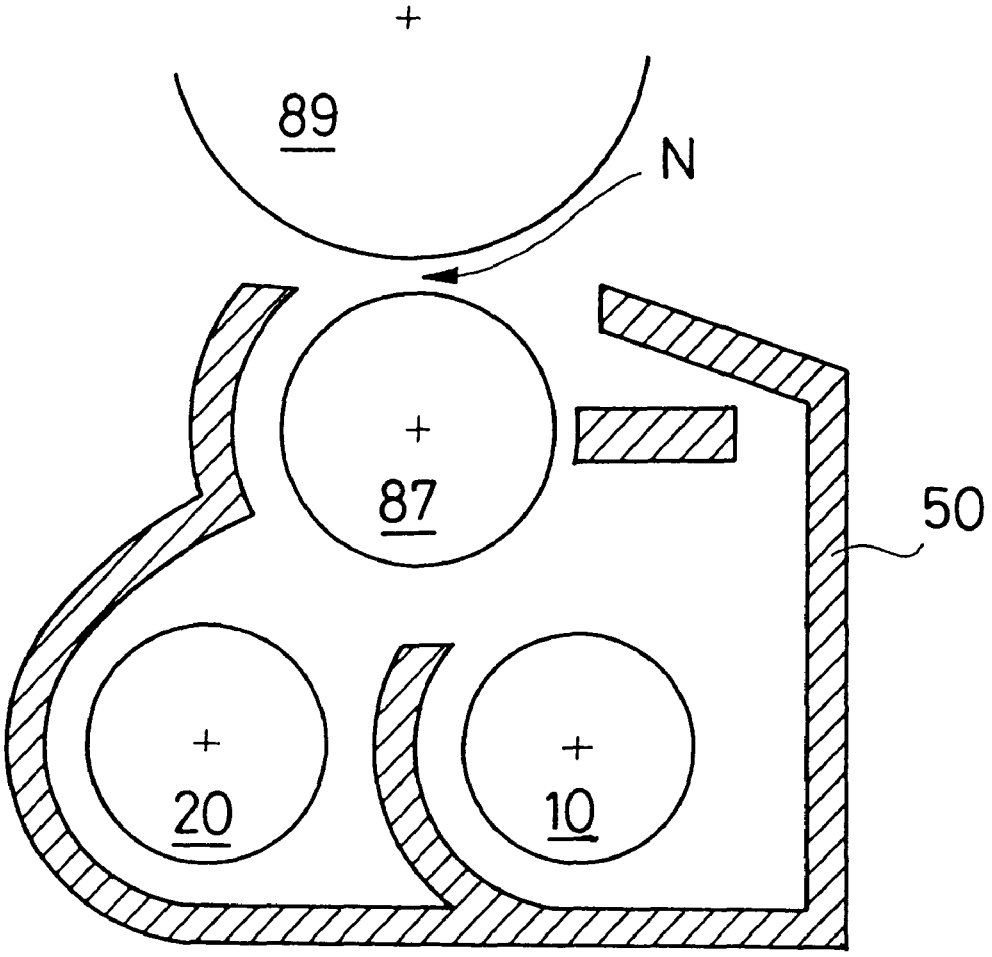
FIG. 2 is a view schematically showing the structure of a horizontal developing device.

The horizontal developing device of FIG. 2 is constructed such that the supply screw 10 and the collection screw 20 are arranged horizontally, except which it is quite the same as the vertical developing device of FIG. 1.

In these developing devices, when the supply screw 10 and the collection screw 20 are rotated by the driving of a rotating driving source such as a motor provided in the image forming apparatus body, the conveying force of these two screws circulates developer within the developing tank 50. With this circulation, the developer is supplied to the developing roll 87 from the supply screw 10 to develop an electrostatic latent image on the photosensitive member 89 through the developing roll 87. Part of the developer supplied to the developing roll 87 which has passed through the developing nip N is collected by the collection screw 20 to be circulated again in the developing tank 50.

Figure 3:
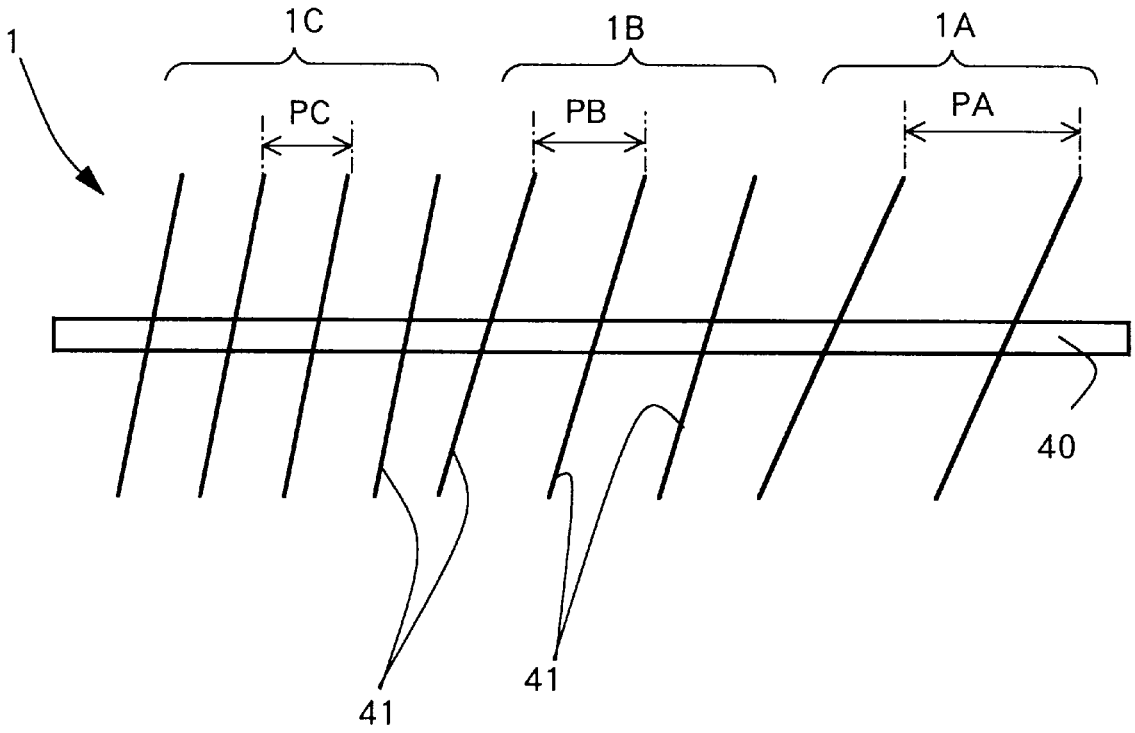
FIG. 3 is a view showing a screw in which the pitch of the screw blades has been varied depending on sections.

Next, the supply screw 10 and the collection screw 20, by which the present invention is characterized in these developing devices, will be described. A screw 1 used as the supply screw 10 or the collection screw 20 is prepared by providing a screw shaft 40 with a large number of screw blades 41 as shown in FIG. 3. The screw 1 is partitioned into section 1A, section 1B and section 1C. Each section is distinguished by a difference in screw pitch. More specifically, the screw pitch PA in the section 1A is the largest, the screw pitch PC in the section 1C is the smallest, and the screw pitch PB in the section 1B is the intermediate between them.

In this respect, the phrase "the screw pitch is large" means that the interval between adjacent screw blades 41 is made large by making the inclination of the screw blade 41 with respect to the shaft 40 steep (causes the screw blade 41 to become more parallel to the shaft 40). Conversely, the phrase "the screw pitch is small" means that the interval between adjacent screw blades 41 is made small by making the inclination of the screw blade 41 with respect to the shaft 40 gentle (causes the screw blade 41 to become more vertical to the shaft 40). When the screw pitch is large, the distance in which developer is conveyed in the axial direction while the screw makes one revolution is long, and therefore, the conveying force is that much stronger. Accordingly, the screw 1 of FIG. 3 has the maximum conveying force in the section 1A, and the minimum conveying force in the section 1C. The conveying force in the section 1B is intermediate between them. In the section with a strong conveying force, the flow velocity of developer which flows through the section is that much faster.

When the screw 1 is used as the supply screw 10, it is provided so that the section 1A is positioned on the upstream side and the section 1C is positioned on the downstream side. On the other hand, when it is used as the collection screw 20, it is provided so that the section 1A is positioned on the downstream side and the section 1C is positioned on the upstream side. In the developing device, however, since the upstream side of the supply screw 10 is opposed to the downstream side of the collection screw 20, and the downstream side of the supply screw 10 is opposed to the upstream side of the collection screw 20, the sections 1A and 1A, the sections 1B and 1B, and the sections 1C and 1C of these two screws are opposed to each other respectively after all.

Figure 4:
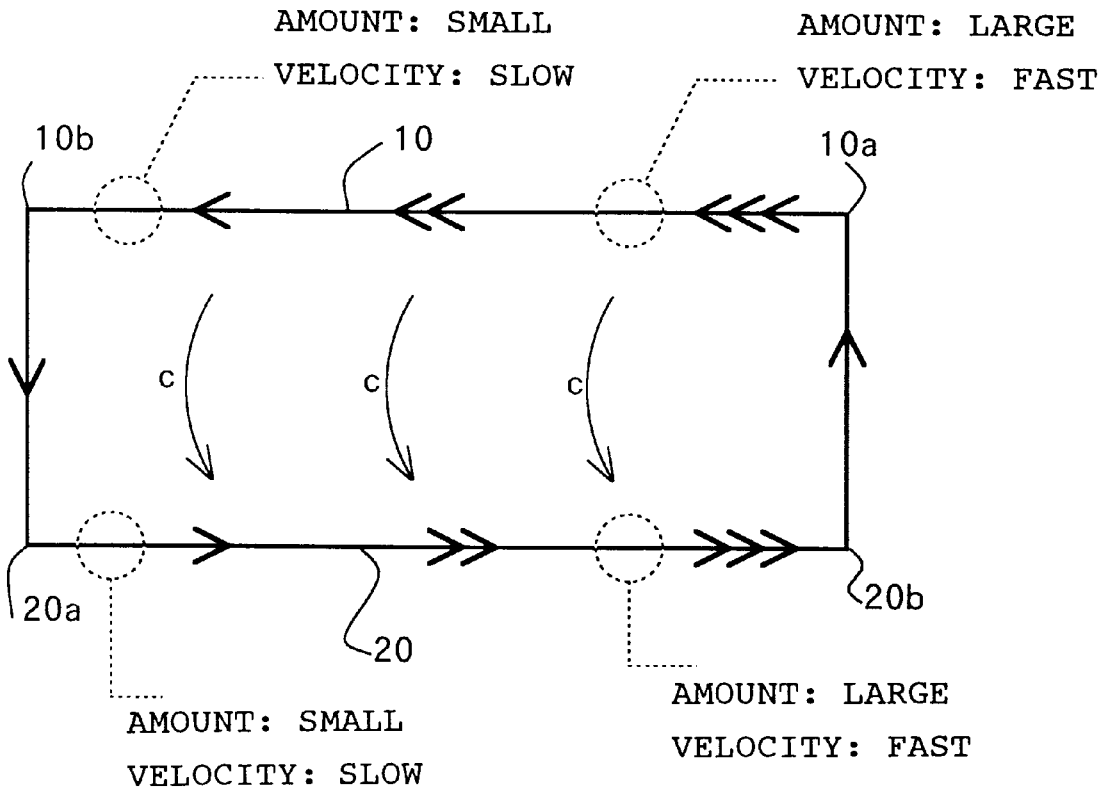
FIG. 4 is a view showing a state of flow of developer in a developing device according to the present invention.
Figure 31:
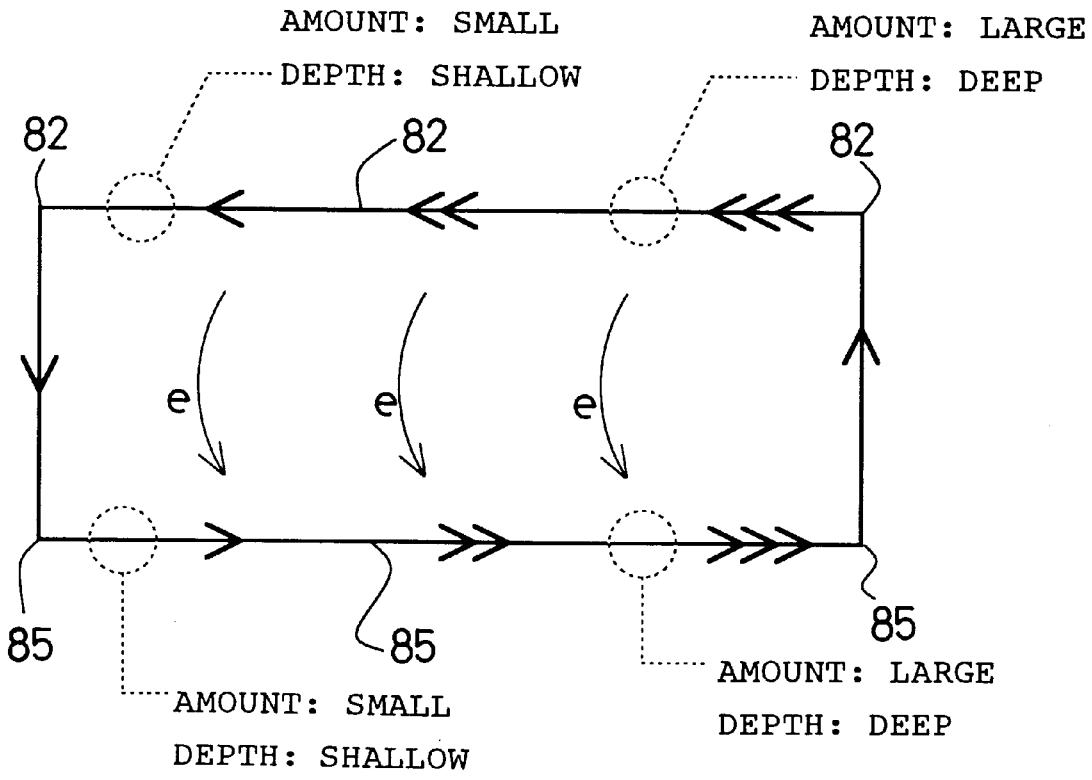
FIG. 31 is a view showing a state of flow of developer in the developing device.
Figure 32:
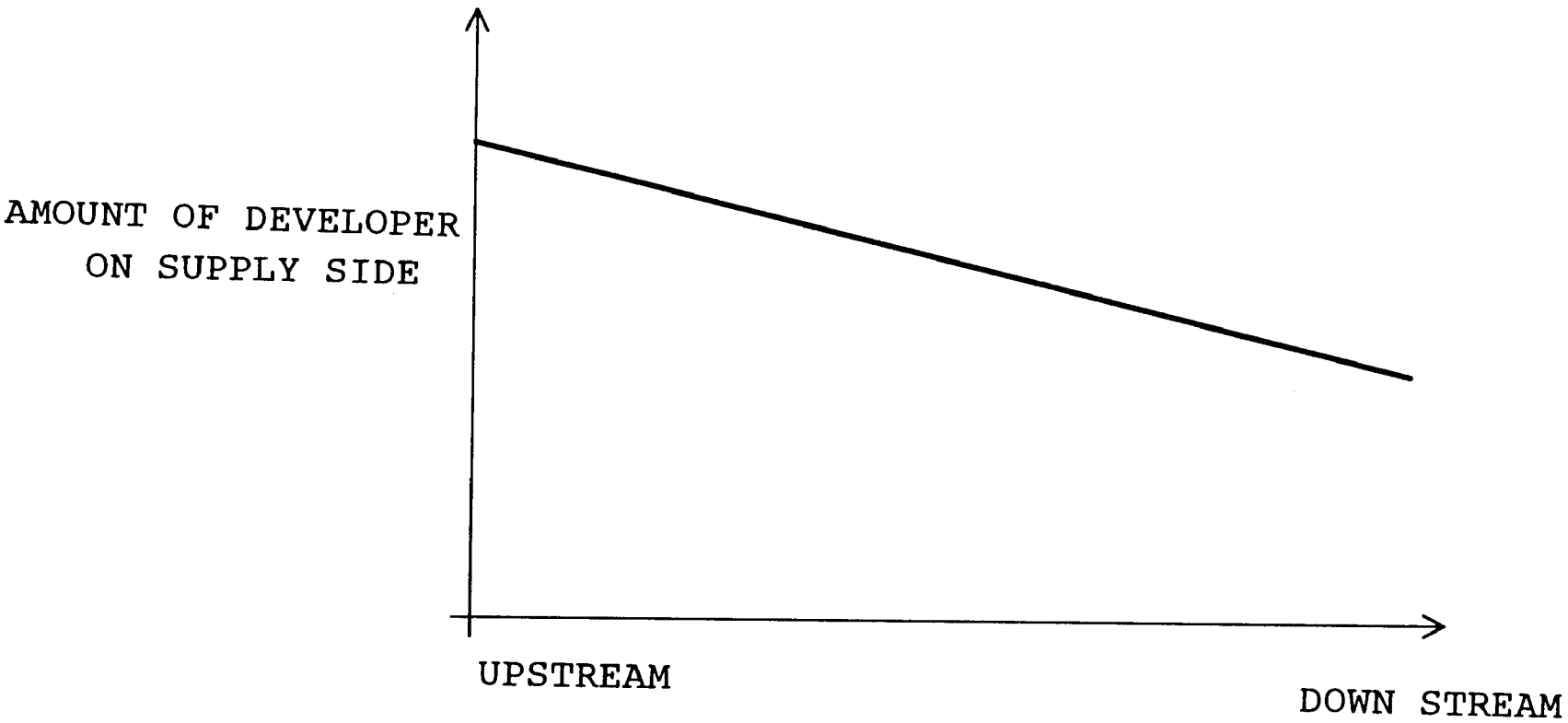
FIG. 32 is a graph showing the distribution state of developer in the supply screw.
Figure 33:
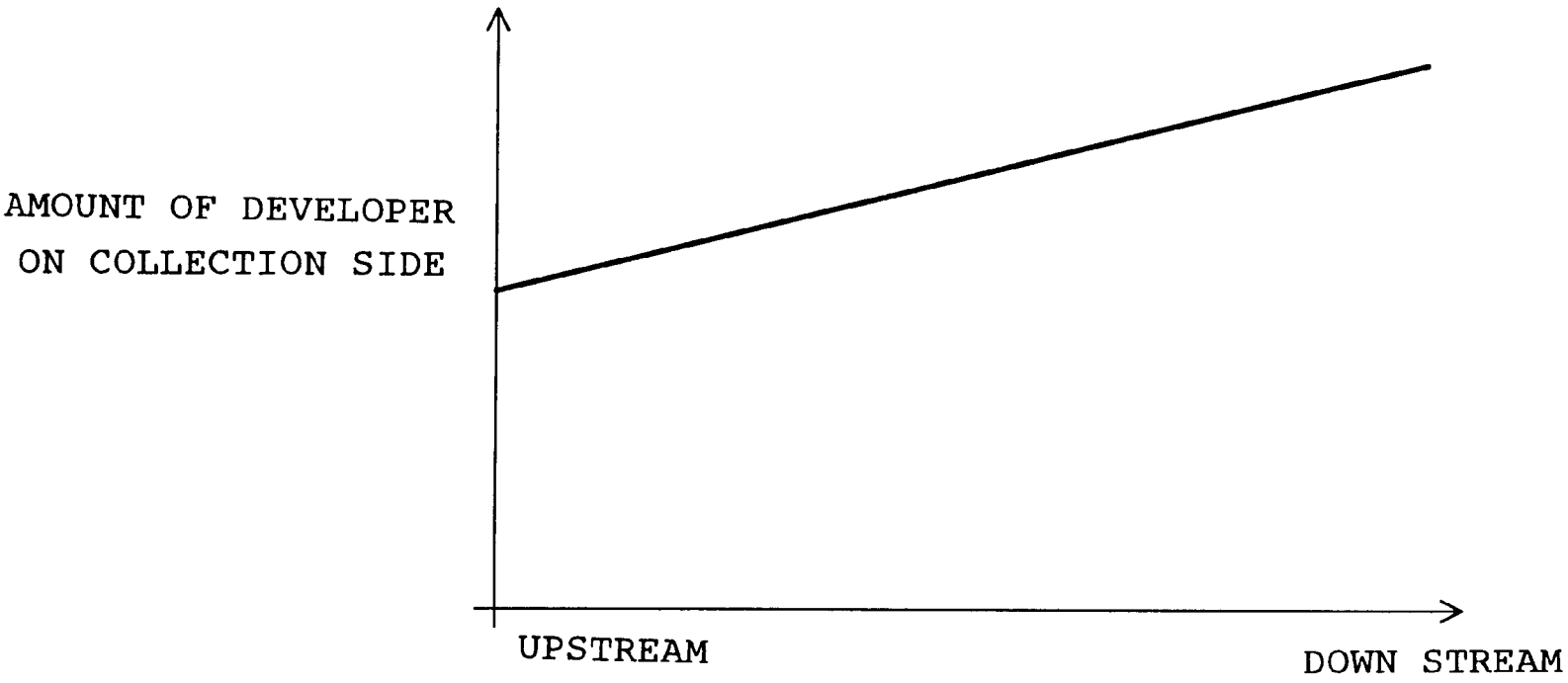
FIG. 33 a graph showing the distribution state of developer in the collection screw.

FIG. 4 schematically shows circulation flow of developer in a developing device in which the supply screw 10 and the collection screw 20 are arranged in this way. The circulation flow of FIG. 4 is basically substantially the same as that of FIG. 31, and the conveying path of the supply screw 10 and that of the collection screw 20 form substantially a quadrilateral. Developer is delivered from the downstream end 10*b* of the conveying path of the supply screw 10 toward the upstream end 20*a* of the conveying path of the collection screw 20, and from the downstream end 20*b* of the conveying path of the collection screw 20 toward the upstream end 10*a* of the conveying path of the supply screw 10. Also, FIG. 4 is the same as FIG. 31 also in that part of the developer supplied to the developing roll 87 from the supply screw 10 passes through the developing nip N and is collected by the collection screw 20. For this reason, the amount of developer conveyed by the supply screw 10 gradually decreases from the upstream end 10*a* toward the downstream end 10*b*. On the other hand, the amount of developer conveyed by the collection screw 20 gradually increases from the upstream end 20*a* toward the downstream end 20*b*. In other words, there is similar inclination to that shown in FIGS. 32 and 33 in quantitative distribution of developer in the developing device.

However, the conveying force in the supply screw 10 and the collection screw 20 varies depending on the section as described above, and a section with a strong conveying force is arranged at a place where there is a large amount of developer, and that a section with a weak conveying force is arranged at a place where there is a small amount of developer. Accordingly, the developer flows at high flow velocity in the place where there is a large amount of developer, and flows at low flow velocity in the place where there is a small amount of developer. Therefore, the depth at which the supply screw 10 and the collection screw 20 are actually immersed in the developer becomes substantially uniform irrespective of the amount of developer at the place. This is because when at high flow velocity, the cross-sectional area of the flow decreases even with the same amount of developer and the depth at which the screw is actually immersed in the developer becomes shallow. For this reason, the supply of developer from the supply screw 10 to the developing roll 87 and the collection from the developing roll 87 toward the collection screw 20 are uniformly performed irrespective of upstream or downstream side. Therefore, no difference is caused in the density of an image formed in accordance with the positions of the supply screw 10 and the collection screw 20 in the width direction (axial direction).

According to this embodiment as described above, it is arranged such that, as the supply screw 10 and the collection screw 20, the screw 1, whose screw pitch differs with the section, is used, that a section with a strong conveying force is arranged in the place where a large amount of developer is distributed, and that a section with a weak conveying force is arranged in the place where a small amount of developer is distributed. Therefore, when developer is circulated, circulation at high flow velocity is obtained in the place where there is a large amount of developer, while circulation at low flow velocity is obtained in the place where there is a small amount of developer. The depth at which each screw 10, 20 is actually immersed in developer becomes uniform in the width direction (axial direction) irrespective of the distribution of developer within the developing device. Thereby, there is provided a developing device in which the delivery of developer with the developing roll 87 can be uniformly made irrespective of the position in the width direction (axial direction). In this case, in this embodiment, it is not necessary to perform control to increase particularly the conveying speed, nor is it necessary to particularly increase the number of parts.

In this respect, the screw 1 of FIG. 3 is partitioned into three sections to provide differences in screw pitch, and the number of sections is not limited to "3". Even two sections are also effective, and the screw 1 may be partitioned into four or more sections. Also, the number of sections may be different between the supply screw 10 and the collection screw 20.

Figure 5:
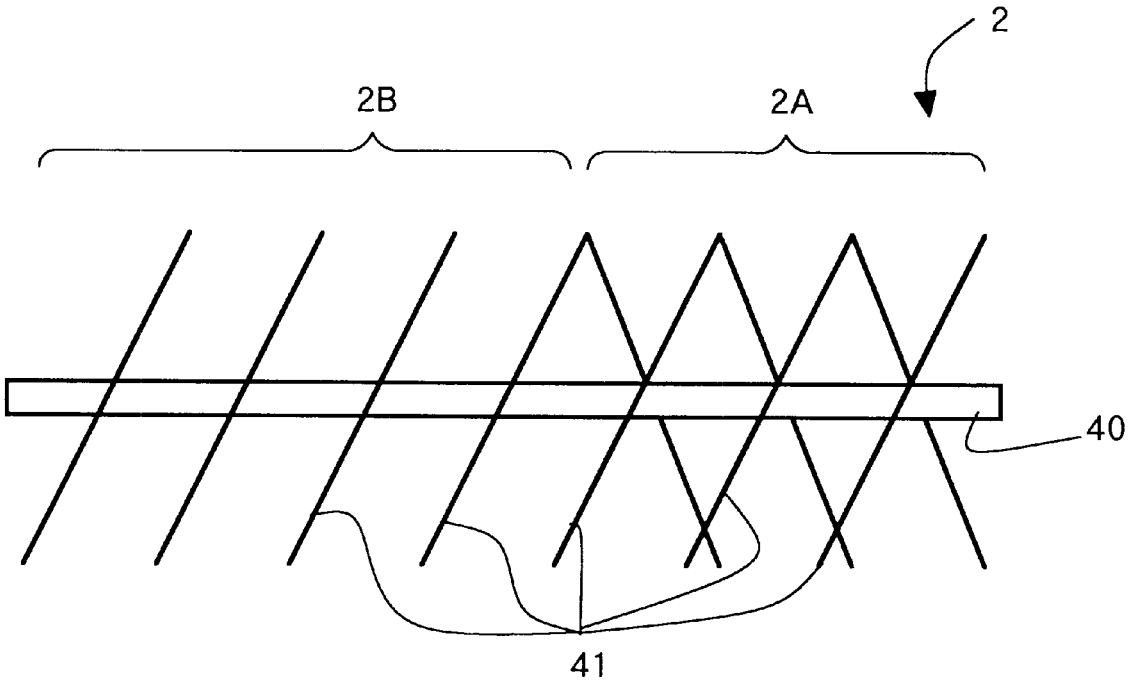
FIG. 5 is a view showing a screw in which the number of threads of the screw blades has been varied depending on sections.

Hereinafter, several screws having other shape which exhibit the same effect as the screw 1 will be listed and described. The screw 2 shown in FIG. 5 is partitioned into section 2A and section 2B. Each section is distinguished by a difference in number of threads in the screw blade 41. More specifically, the section 2A is provided with screw blades 41 each having two threads whereas the section 2B is provided with screw blades 41 each having only one thread. When more threads are provided, conveyance of developer by the screw blades 41 is performed at more places and therefore, the conveying force is that much stronger. Accordingly, in the screw 2, the section 2A exhibits a stronger conveying force than the section 2B.

When it is used as the supply screw 10, the screw 2 is provided so that the section 2A is positioned on the upstream side, and the section 2B is positioned on the downstream side. On the other hand, when it is used as the collection screw 20, the screw 2 is provided so that the section 2A is positioned on the downstream side, and the section 2B is positioned on the upstream side. In the developing device, however, the upstream side of the supply screw 10 is opposed to the downstream side of the collection screw 20, and the downstream side of the supply screw 10 is opposed to the upstream side of the collection screw 20, and therefore, the sections 2A and 2A, and the sections 2B and 2B of these two screws are opposed to each other respectively after all.

Even in a developing device structured using this screw 2, as in the case of the developing device using the screw 1, the depth at which the supply screw 10 or the collection screw 20 is actually immersed in developer is made uniform, and the delivery of developer with the developing roll 87 is uniformly performed irrespective of the position in the width direction (axial direction). In this respect, the screw 2 of FIG. 5 is partitioned into two sections to provide a difference in number of threads of the screw, and the number of sections is not limited to "2", but "3" or more may be used, or the number of sections may be different between the supply screw 10 and the collection screw 20. Further, as the supply screw 10, the screw 1 of FIG. 3 may be used, and as the collection screw 20, the screw 2 of FIG. 5 may be used, or it may be reversed.

Figure 6:
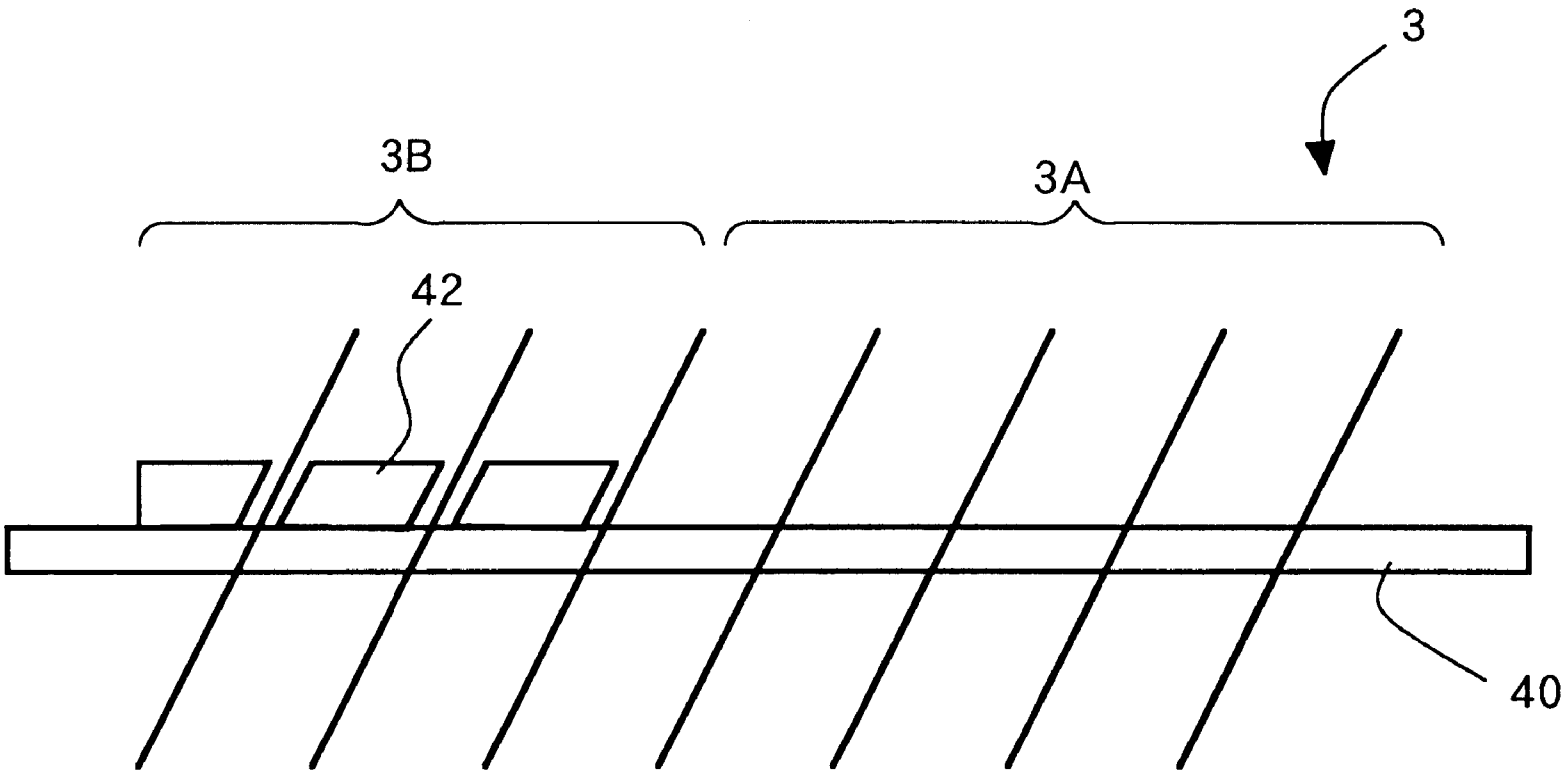
FIG. 6 is a view showing a screw in which paddles are provided between the screw blades depending on sections.

The screw 3 shown in FIG. 6 is partitioned into the section 3A and the section 3B. Each section is distinguished by the presence or absence of paddles 42 provided at the screw blade 41. More specifically, in the section 3B, a paddle 42 is provided between each screw blade 41 whereas in the section 3A, no paddles are provided. In this case, the paddle 42 is a flat plate-shaped member mounted to the shaft 40, and is provided so as to form a plane which is substantially perpendicular to the screw blade 41 and includes the shaft 40. When the paddle 42 is provided, the range within which the paddle 42 sweeps by the rotation of the screw 3 does not contribute to the conveyance of developer. In other words, the paddle 42 is a member of hindering the conveyance of developer. Accordingly, in the screw 3, the section 3A exhibits a stronger conveying force than the section 3B.

When it is used as the supply screw 10, the screw 3 is provided so that the section 3A is positioned on the upstream side and the section 3B is positioned on the downstream side. On the other hand, when it is used as the collection screw 20, the screw 3 is provided so that the section 3A is positioned on the downstream side and the section 3B is positioned on the upstream side. In the developing device, however, the upstream side of the supply screw 10 is opposed to the downstream side of the collection screw 20, and the downstream side of the supply screw 10 is opposed to the upstream side of the collection screw 20, and therefore, the sections 3A and 3A, and the sections 3B and 3B of these two screws are opposed to each other respectively after all.

Even in a developing device structured using this screw 3, as in the case of the above-described developing device using each screw 1, 2, the depth at which the supply screw 10 or the collection screw 20 is actually immersed in developer is made uniform, and the delivery of developer with the developing roll 87 is uniformly performed irrespective of the position in the width direction (axial direction). In this respect, the screw 3 of the FIG. 6 is partitioned into two sections by the presence or absence of the paddle 42, and three or more sections may be provided by providing a difference in size or shape of the paddle 42. Also, as can be seen from the FIG. 6, the section 3A and the section 3B may not always be the same in length. Three or more sections may be provided by a combination of the presence or absence of the paddle 42 and the number of threads (or pitch) of the screw blade 41. For example, the section having the maximum conveying force has "two" threads and no paddle 42, the section having the intermediate conveying force has "one" thread and no paddle 42, and the section having the minimum conveying force has "one" thread and paddles 42. Also, the type and the number of sections may be different between the supply screw 10 and the collection screw 20.

Figure 7:
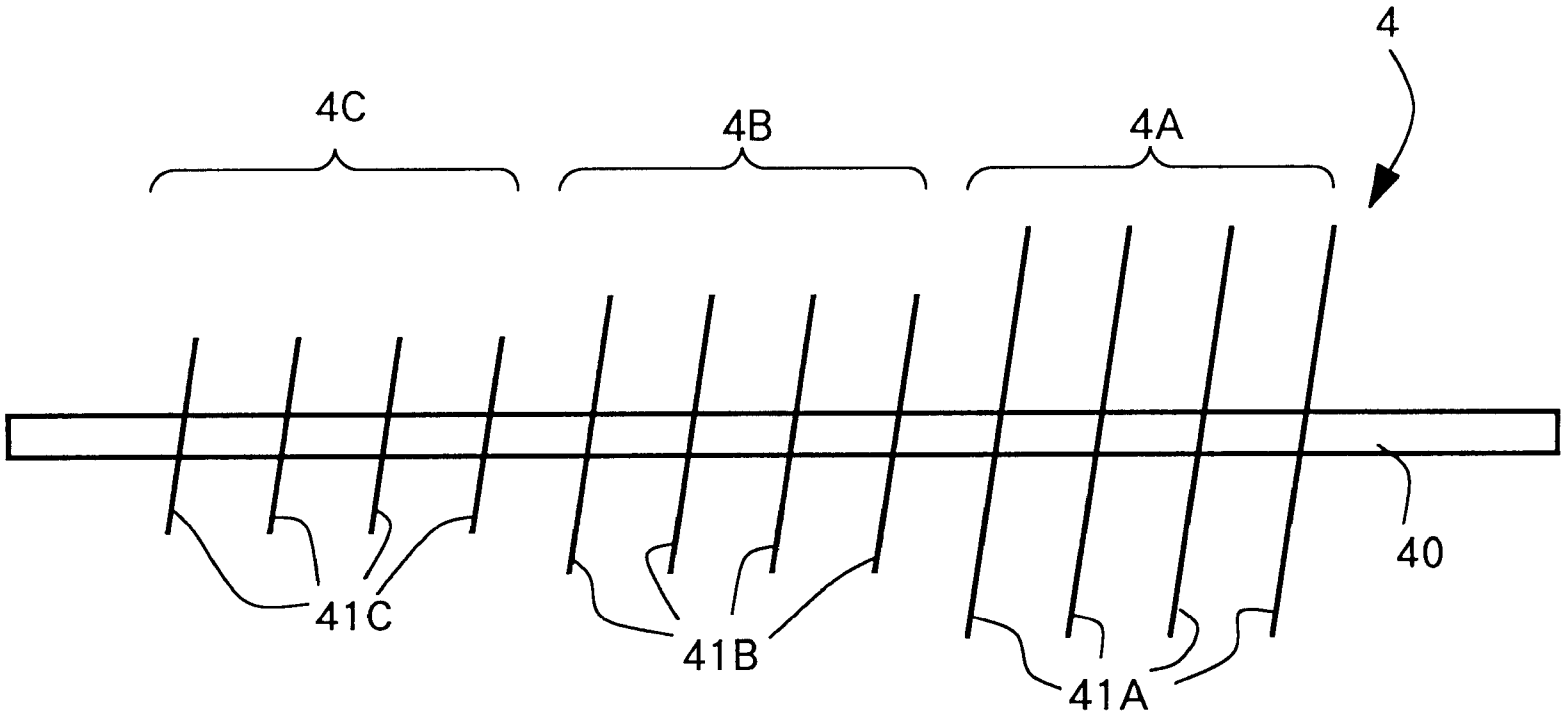
FIG. 7 is a view showing a screw in which the size of the screw blade is varied depending on sections.

The screw 4 shown in FIG. 7 is partitioned into three sections, that is, section 4A, section 4B and section 4C. Each section is distinguished by differences in size of the screw blade 41. More specifically, the section 4A is provided with screw blades 41A (See FIG. 8), each with a large diameter whereas the section 4C is provided with screw blades 41C (See FIG. 8), each having a small diameter. The section 4B is provided with screw blades 41B (See FIG. 8), each having an intermediate diameter between them. When the screw blade 41 is large in size, the effective area for conveying developer is large, and its conveying force is that much stronger. Therefore, in the screw 4, the section 4A exhibits a stronger conveying force than the section 4C, and the section 4B exhibits the intermediate conveying force between them.

When it is used as the supply screw 10, the screw 4 is provided so that the section 4A is positioned on the upstream side and the section 4C is positioned on the downstream side. On the other hand, when it is used as the collection screw 20, the screw 4 is provided so that the section 4A is positioned on the downstream side and the section 4C is positioned on the upstream side. In the developing device, however, the upstream side of the supply screw 10 is opposed to the downstream side of the collection screw 20, and the downstream side of the supply screw 10 is opposed to the upstream side of the collection screw 20, and therefore, the sections 4A and 4A, and the sections 4C and 4C of these two screws are opposed to each other respectively after all.

Even in a developing device structured using this screw 4, as in the case of the above-described developing device using each screw 1, 2, the depth at which the supply screw 10 or the collection screw 20 is actually immersed in developer is made uniform, and the delivery of developer with the developing roll 87 is uniformly performed irrespective of the position in the width direction (axial direction). In this respect, the screw 4 of FIG. 7 is partitioned into three sections, in which differences are provided in diameter of the screw blade, and the number of sections is not limited to "3". Even if two sections are provided, it is effective, and the screw may be partitioned into four or more sections. Further, The sections may be discriminated by a combination of a difference in diameter of screw blade and a difference in another element (such as screw pitch). For example, in the section with the maximum conveying force, both the diameter of the screw blade and the pitch are made "large", in the section with the intermediate conveying force, only one of the diameter and the pitch is made "large", while the other is made "small", and in the section with the minimum conveying force, both are made "small". Also, the type and the number of sections may be different between the supply screw 10 and the collection screw 20.

Figure 9:
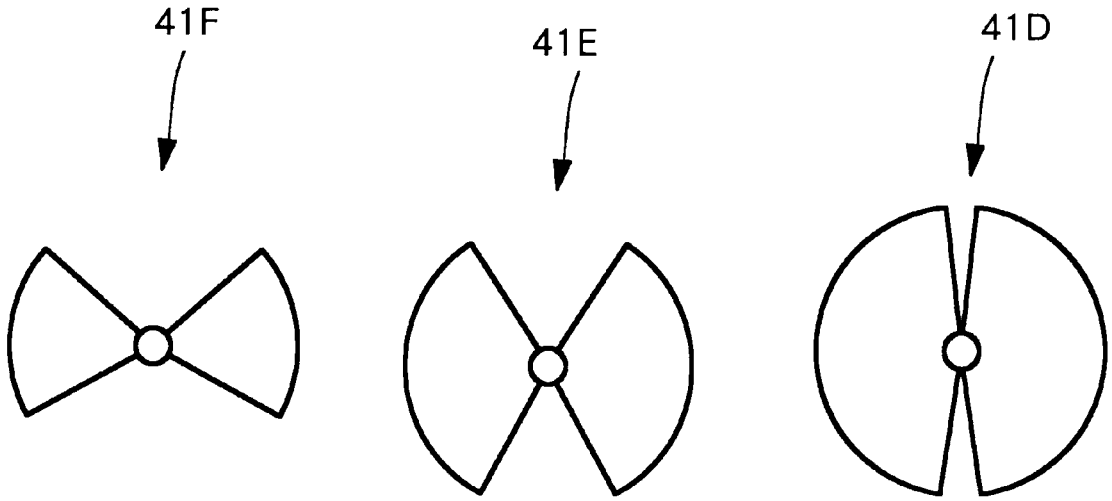
FIG. 9 is a view showing screw blades whose center angles are made different from one another.
Figure 10:
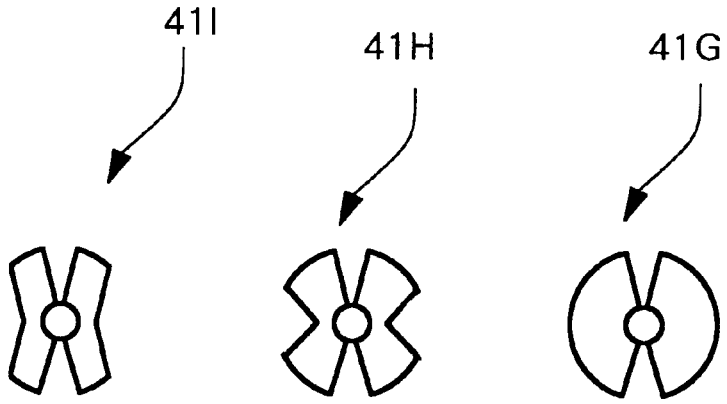
FIG. 10 is a view showing screw blades whose notches are made different from one another in size.
Figure 11:
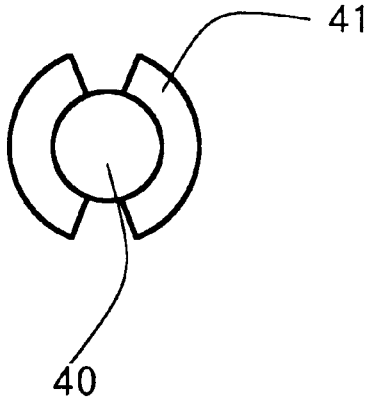
FIG. 11 is a view showing a case where the shaft diameter is changed to change the effective area of the screw.

In the screw 4 of FIG. 7, differences are provided in effective area by varying the outer diameter of the screw blade 41, and the means of varying the effective area of the screw blade 41 is not limited to this method. The effective area of the screw blade 41 can be changed by varying the width of, for example, the center angle as shown in FIG. 9. More specifically, the screw blade 41D with the widest center angle has the maximum effective area, and the screw blade 41F with the narrowest center angle has the minimum effective area. Also, the effective area of the screw blade 41 can be changed even by the presence or absence and size of the notch as shown in FIG. 10. More specifically, the screw blade 41G without notch has the maximum effective area, and the screw blade 41I having large notches has the minimum effective area. The effective area of the screw blade 41H having small notches is intermediate between them. Also, it is possible to provide a difference in effective area by varying the diameter of the shaft 40. More specifically, when the shaft 40 is caused to have a large diameter as shown in FIG. 11, the screw blade 41 at the place has a small effective area if the same in outer diameter and the like.

Figure 12:
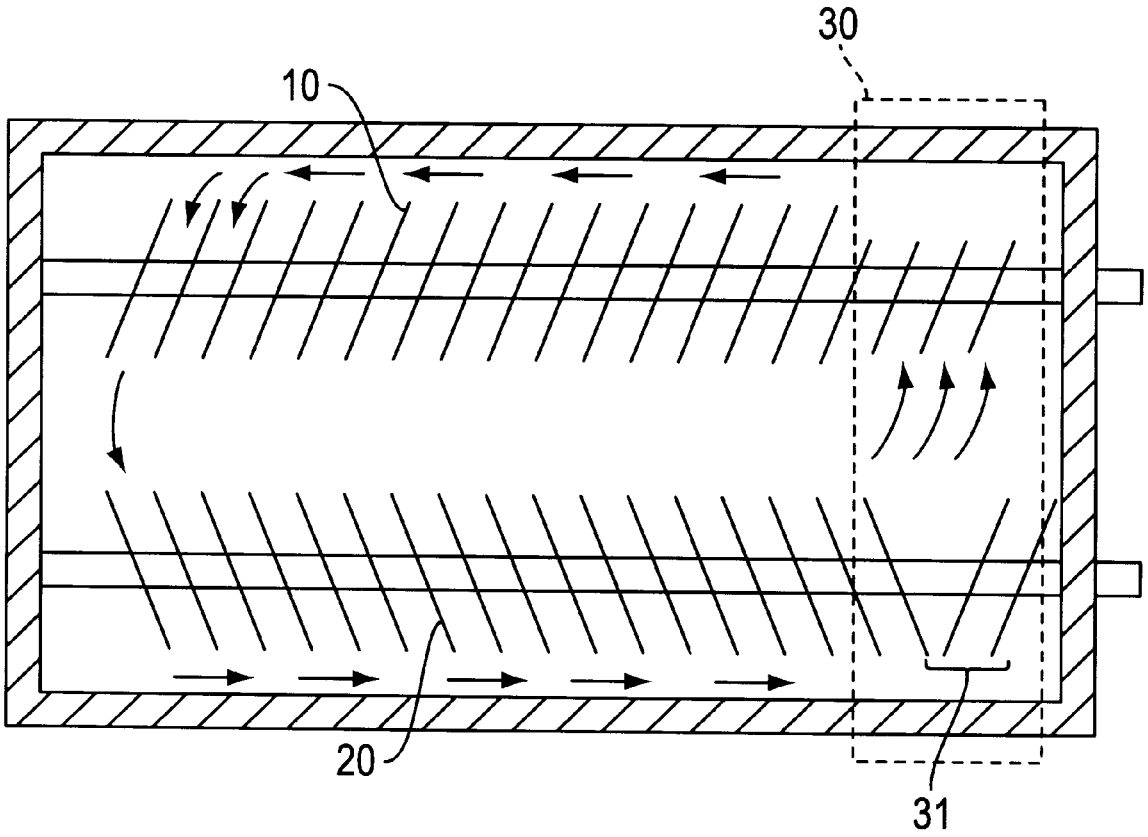
FIG. 12 is a view schematically showing the structure of an example of the vertical developing device.

In this respect, among vertical developing devices, there are some vertical developing devices in which in a carry-up area 30 where developer is carried up from the collection screw 20 toward the supply screw 10, a surging range 31 is provided for the collection screw 20 as shown in FIG. 12 to facilitate the carry-up of developer by adjusting the conveying force in this area. When the present invention is applied to such a developing device, a difference can be provided in conveying force as described above for other portions than the carry-up area 30 in the supply screw 10 or the collection screw 20.

In this respect, the above-described embodiment is only a mere exemplification, and does not restrict the present invention. Accordingly, it is naturally possible to improve and modify the present invention in various ways so long as these are not departed from the gist thereof. For example, in the above-described embodiment, a difference in conveying force is provided for both the supply screw 10 and the collection screw 20, and even in a case where such a difference is provided for only one of them, the significant effect is recognized.

Second Embodiment

Figure 13:
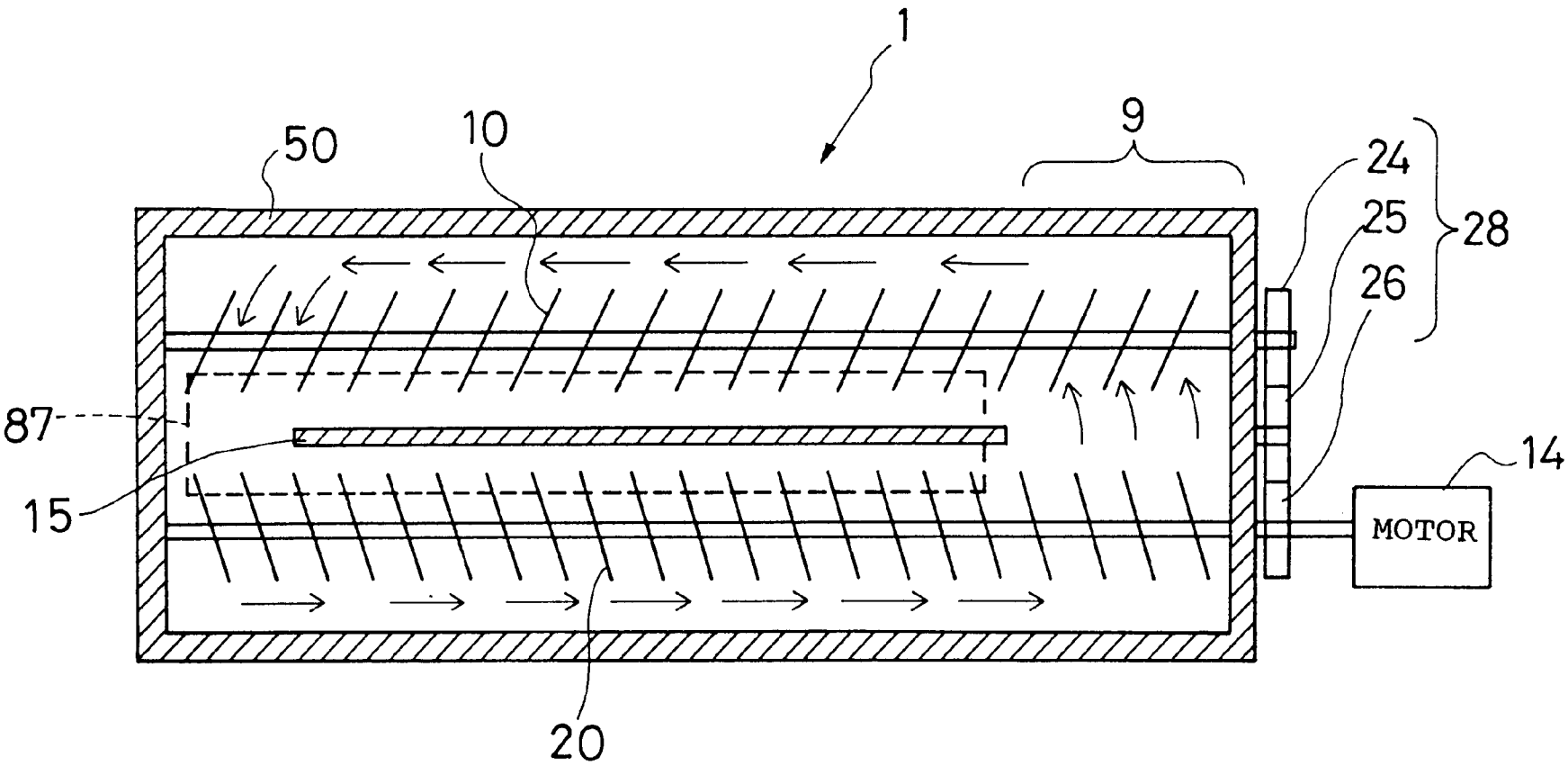
FIG. 13 is an explanatory view for illustrating the structure of a developing device according to a second embodiment.

A developing device according to this embodiment is constructed such that as shown in FIG. 13, two screws, that is, the supply screw 10 and the collection screw 20, are provided in parallel with each other within a developer storage tank 50 for containing developer. However, the directions of inclination of the respective screw blades are opposite to each other. Each shaft of the supply screw 10 and the collection screw 20 is coupled to each other through a gear train 28 outside the developer storage tank 50. Further, the shaft of the collection screw 20 is provided with a motor 14 controlled from the side of the image forming apparatus body. In the gear train 28, the gear 26 for the collection screw 20 has a larger number of teeth than the gear 24 for the supply screw 10. Between the gear 26 and the gear 24, there is also provided a mid gear 25. When the motor 14 is rotated, this mid gear 25 is adapted to rotate the supply screw 10 and the collection screw 20 in the same direction so that the former rotates faster than the latter.

Figure 14:
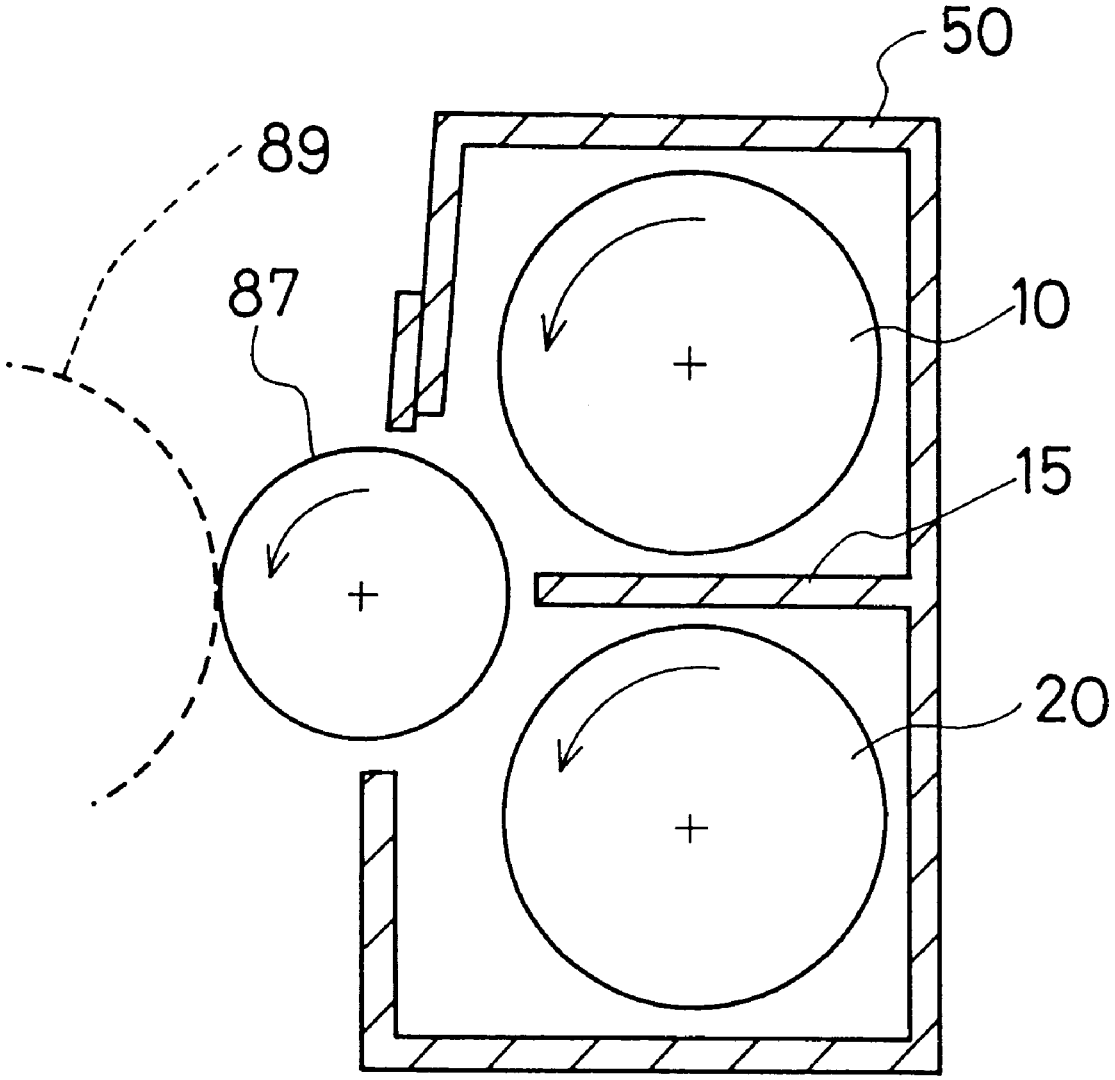
FIG. 14 is side cross-sectional view showing the developing device of FIG. 13.

These two screws are arranged in the vertical direction as shown in the side cross-sectional view of FIG. 14 so that the supply screw 10 and the collection screw 20 are positioned in the upper stage and in the lower stage respectively. Also, in a position in height between the supply screw 10 and the collection screw 20, the developing roll 87 is provided in such a state that its portion projects from the developer storage tank 50.

Between the supply screw 10 and the collection screw 20, there is provided a partition wall 15. However, the partition wall 15 does not extend over the entire area of the developing device in the width direction (right and left direction in FIG. 13), but the upper and lower sides are connected on its both sides. Of these, the portion, whose upper and lower sides are connected on the right side in FIG. 13 from the partition wall 15, constitutes a carry-up portion 9 in which developer is carried up from the lower collection screw 20 toward the upper supply screw 10 as described later.

The operation of this developing device will be described. When the motor 14 is rotated under the control from the side of the image forming apparatus body, the collection screw 20 coaxial to the motor 14 rotates. The rotation is transmitted to the supply screw 10 through the gear train 28 to rotate also the supply screw 10 in the same direction as the collection screw 20 faster than it. The rotation of the supply screw 10 and the collection screw 20 generates the conveying force to developer in the developer storage tank 50. Since, however, the supply screw 10 and the collection screw 20 are opposite to each other in the direction of inclination of the screw blades as described above, the directions of conveyance of the developer are up and down, and opposite. In FIG. 13, the developer is conveyed to the left by the upper supply screw 10 while the developer is conveyed to the right by the lower collection screw 20. The developer conveyed by the supply screw 10 to reach the left-side end falls down to the lower collection screw 20. The developer conveyed by the collection screw 20 to reach the right-side end, that is, the carry-up portion 9 overflows upwardly to the supply screw 10. Thus, the developer is circulated around the partition wall 15 in the counterclockwise direction within the developer storage tank 50.

With the circulation of developer, part of the developer in the upper supply screw 10 is supplied to the developing roll 87. This enables the developing roll 87 to impart toner to an electrostatic latent image on the photosensitive drum 89 for development. Also, the surplus developer on the developing roll 87 is collected by the lower collection screw 20.

In the circulation of developer, since the upper supply screw 10 rotates faster than the lower collection crew 20, the upper supply screw 10 is also stronger in the conveying ability of developer. For this reason, the side of the supply screw 10 is in a slightly negative pressure state in the carry-up portion 9. Accordingly the developer conveyed by the collection screw 20 to reach the carry-up portion 9 is sucked up from above, and therefore, the carry-up of the developer from the lower stage to the upper stage is smoothly performed against the hindrance of gravity so that the developer does not stagnate in the circulation. On the lower stage side of the carry-up portion 9, the rotating resistance of the collection screw 20 does not increase owing to stagnant developer, nor is any excessive stress applied on the developer.

As described in detail above, according to this embodiment, in a developing device for supplying developer to the developing roll 87 and collecting while circulating it by the supply screw 10 and the collection screw 20 which have been arranged up and down, the upper supply screw 10 is adapted to rotate faster than the lower collection screw 20 to exhibit more powerful conveying force, and therefore, developer is sucked up on the upper stage side in the carry-up portion 9 where developer is carried up from the lower stage to the upper stage, and the carry-up of developer is smoothly performed against the hindrance of gravity. Thus, there is realized an excellent developing device in which stagnant developer in the carry-up portion 9 is prevented, and in which any increase in the necessary driving torque due to increased rotating resistance in the collection screw 20 and deterioration (such as adhesion) due to stress of developer are not caused.

In this respect, this embodiment is only a mere exemplification, and does not restrict the present invention. Accordingly, it is naturally possible to improve and modify the present invention in various ways so long as these are not departed from the gist thereof. For example, in both the supply screw 10 and the collection screw 20, the directions of inclination of the screw blades may be made the same to reverse the direction of rotation by changing the gear train 28 instead.

Third Embodiment

This embodiment is structured such that instead of providing a difference in rotating speed between the supply screw 10 and the collection screw 20, a difference in pitch of screw in the carry-up portion 9 is provided between the upper side and the lower side to thereby make the conveying ability of the upper supply screw 10 stronger in the carry-up portion 9.

Figure 15:
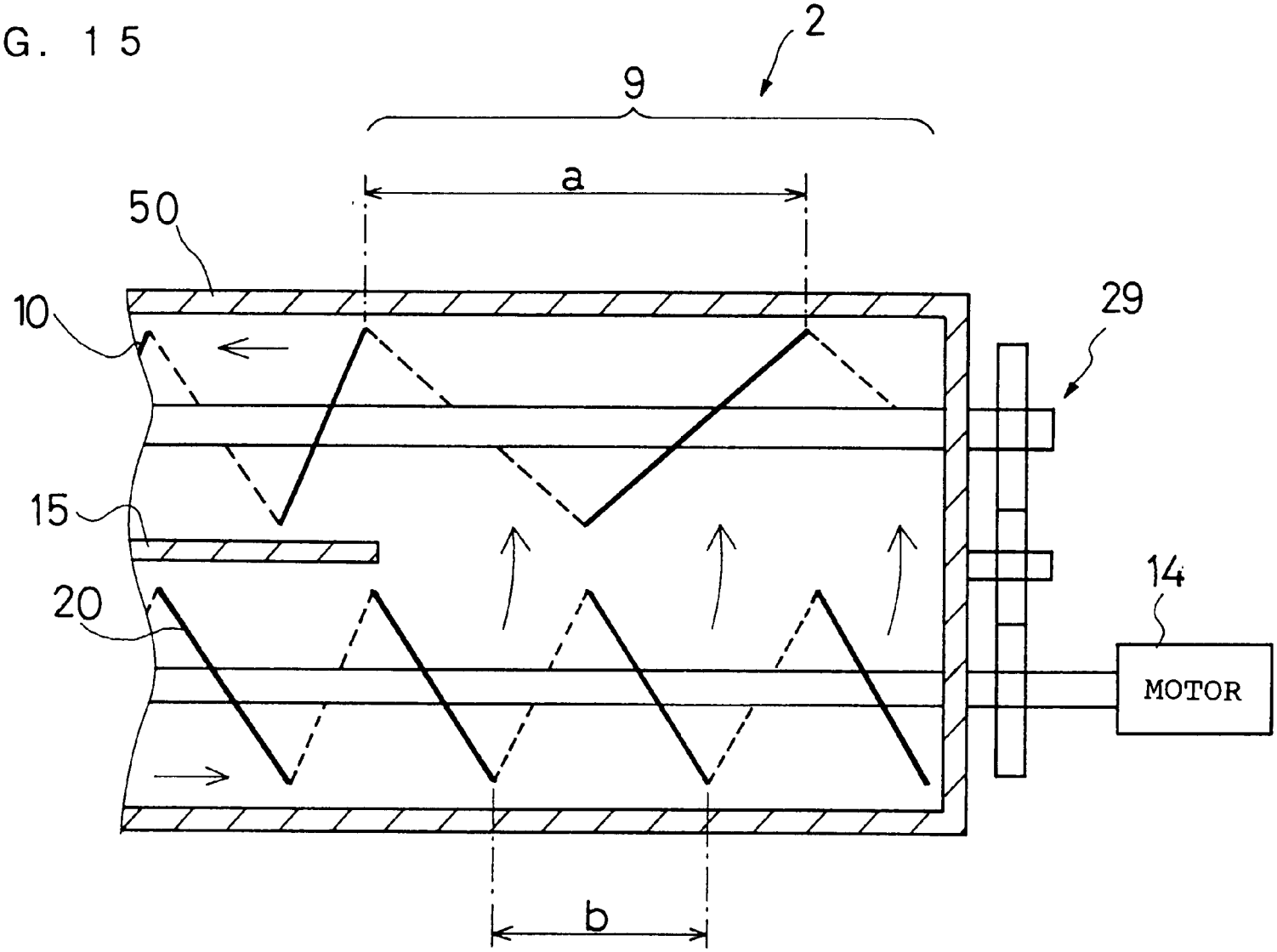
FIG. 15 is an explanatory view for illustrating the structure of a developing device according to a third embodiment.

More specifically, in a developing device according to this embodiment, the pitch a of the upper supply screw 10 is adapted to be larger than the pitch b of the lower collection screw 20 in the carry-up portion 9 as shown in FIG. 15. On the other hand, the gear train 29 of the developing device is arranged such that the rotating speed of the supply screw 10 is the same as that of the collection screw 20. In the other respects, this embodiment is quite the same as the second embodiment.

In such a developing device, when the motor 14 is rotated under the control from the image forming apparatus body side, the collection screw 20 and the supply screw 10 rotate. The rotation of the supply screw 10 and the collection screw 20 circulates the developer in the developer storage tank 50 as in the case of the above-described second embodiment to thereby supply the developer to the developing roller 18 and collect.

In this circulation of developer, since the upper supply screw 10 has larger pitch than the lower collection screw 20 in the carry-up portion 9, the upper supply screw 10 has stronger conveying ability of developer. For this reason, since the supply screw 10 side is in a slightly negative pressure state in the carry-up portion 9, the developer conveyed by the collection screw 20 to reach the carry-up portion 9 will be sucked up from above. Accordingly, the carry-up of the developer from the lower stage to the upper stage is smoothly performed against the hindrance of gravity so that the developer does not stagnate in the circulation. On the lower stage side of the carry-up portion 9, the rotating resistance of the collection screw 20 does not increase owing to stagnant developer, nor is any excessive stress applied on the developer.

In this embodiment, since the upper supply screw 10 is adapted to exhibit a stronger conveying force than the lower collection screw 20 by the provision of a difference in pitch between the upper and lower screws in the carry-up portion 9, developer is sucked up on the upper stage side in the carry-up portion 9 where developer is carried up from the lower stage to the upper stage. and the carry-up of developer is smoothly performed against the hindrance of gravity. Thus, there is realized an excellent developing device in which stagnant developer in the carry-up portion 9 is prevented, and in which any increase in the necessary driving torque due to increased rotating resistance in the collection screw 20 and deterioration (such as adhesion) due to stress to developer are not caused. In this respect, the above-described embodiment is only a mere exemplification, and does not restrict the present invention. Accordingly, it is naturally possible to improve and modify the present invention in various ways so long as these are not departed from the gist thereof.

Fourth Embodiment

Figure 16:
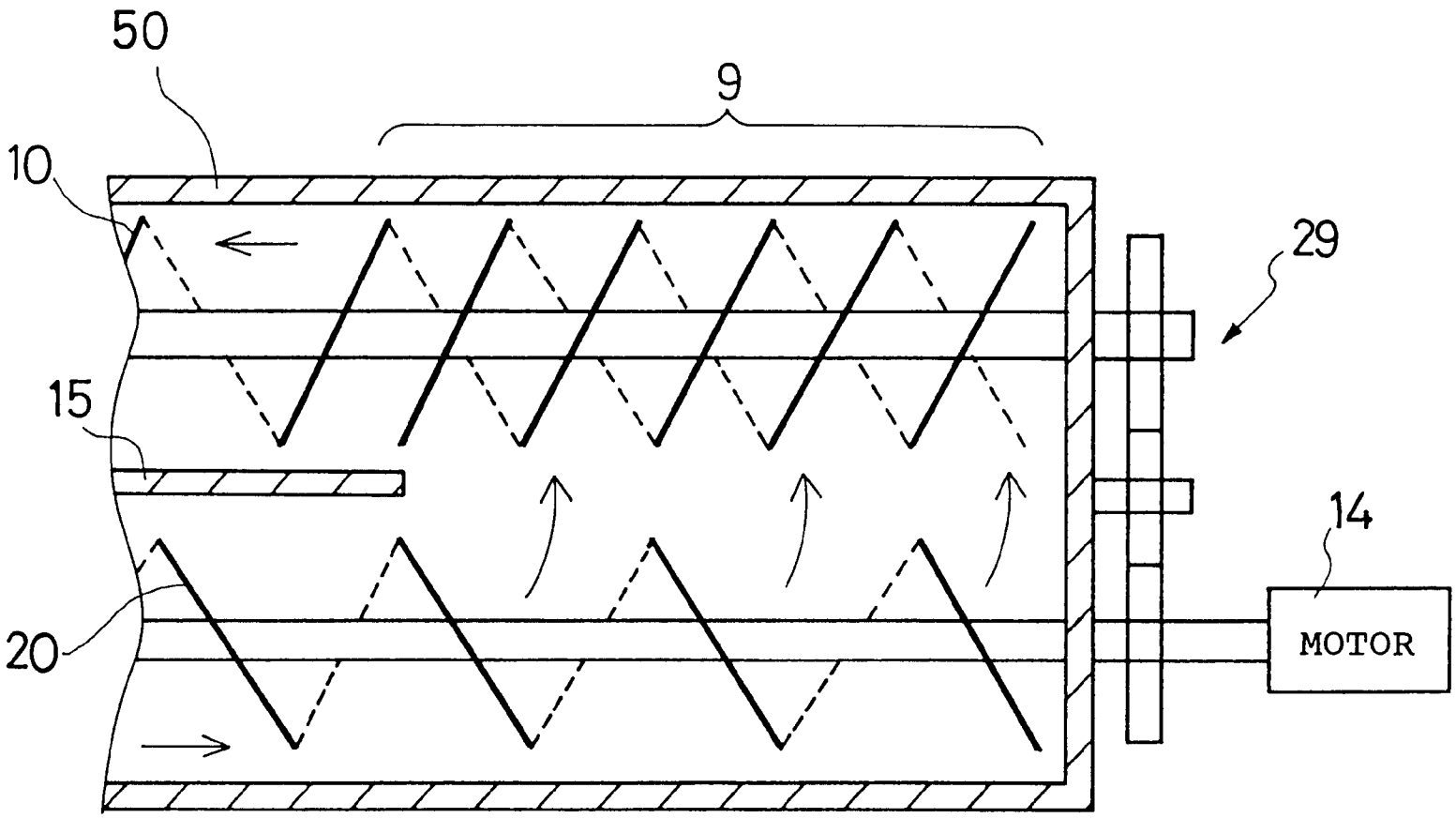
FIG. 16 is an explanatory view for illustrating the structure of a developing device according to a fourth embodiment.

This embodiment is structured such that instead of providing a difference in rotating speed between the supply screw 10 and the collection screw 20, a difference in the number of threads of the screw in the carry-up portion 9 is provided between the upper side and the lower side to thereby make the conveying ability of the upper supply screw 10 stronger in the carry-up portion 9. More specifically, in a developing device according to this embodiment, the upper supply screw 10 is provided with screw blades each having two threads in the carry-up portion 9 as shown in FIG. 16. In contrast, the lower collection screw 20 is provided with screw blades each having only one thread. On the other hand, the gear train 29 of the developing device is arranged such that the rotating speed of the supply screw 10 is the same as that of the collection screw 20 as in the case of the third embodiment. In the other portions, this embodiment is quite the same as the second or third embodiment.

In this developing device, when the motor 14 is rotated under the control from the image forming apparatus body side, the collection screw 20 and the supply screw 10 rotate. The rotation of the supply screw 10 and the collection screw 20 circulates the developer in the developer storage tank 50 as in the case of the above-described second or third embodiment to thereby supply the developer to the developing roller 18 and collect.

In this circulation of developer, since the upper supply screw 10 has more threads than the lower collection screw 20 in the carry-up portion 9, the upper supply screw 10 has stronger conveying ability of developer. For this reason, since the supply screw 10 side is in a slightly negative pressure state in the carry-up portion 9 as in the case of each embodiment described above, the developer conveyed by the collection screw 20 to reach the carry-up portion 9 will be sucked up from above. Accordingly, the carry-up of the developer from the lower stage to the upper stage is smoothly performed against the hindrance of gravity so that the developer does not stagnate in the circulation. On the lower stage side of the carry-up portion 9, the rotating resistance of the collection screw 20 does not increase owing to stagnant developer, nor is any excessive stress applied on the developer.

In this embodiment, since the upper supply screw 10 is adapted to exhibit a stronger conveying force than the lower collection screw 20 by the provision of a difference in number of screw blades between the upper and lower screws in the carry-up portion 9, developer is sucked up on the upper stage side in the carry-up portion 9 where developer is carried up from the lower stage to the upper stage so that the carry-up of developer is smoothly performed against the hindrance of gravity. Thus, there is realized an excellent developing device in which stagnant developer in the carry-up portion 9 is prevented, and in which any increase in the necessary driving torque due to increased rotating resistance in the collection screw 20 and deterioration (such as adhesion) due to stress to developer are not caused. In this respect, this embodiment is only a mere exemplification, and does not restrict the present invention. Accordingly, it is naturally possible to improve and modify the present invention in various ways so long as these are not departed from the gist thereof.

Fifth Embodiment

Figure 8:
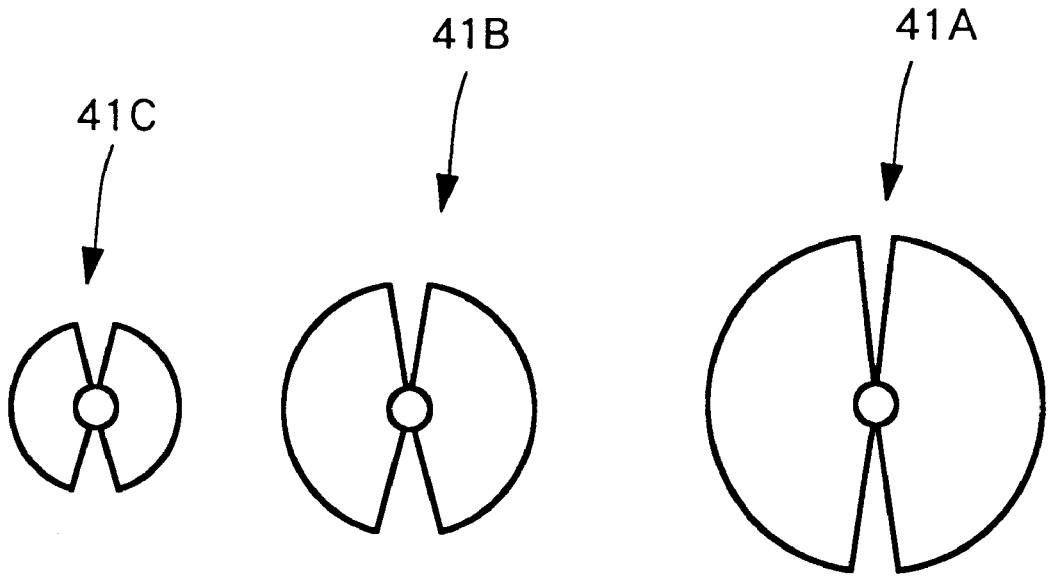
FIG. 8 is a view showing screw blades used for the screw of FIG. 7.

This embodiment is structured such that a difference in effective area of screw blade in the carry-up portion 9 is provided between the upper side and the lower side to thereby make the conveying ability of the upper supply screw 10 stronger in the carry-up portion 9. More specifically, in a developing device according to this embodiment, a screw blade having such small an effective area as shown in any of FIGS. 8 to 11 is used for the lower collection screw 20 in the carry-up portion 9. That is, screw blades 41B, C of FIG. 8, each having a small outer diameter, screw blades 41E, F of FIG. 9, each having a small center angle, screw blades 41H, I of FIG. 10, each having notches, and a screw blade of FIG. 11 having a large shaft diameter. In contract, for the upper supply screw 10, a screw blade having such a large effective area as the screw blade 41A of FIG. 8 is used.

On the other hand, the gear train 29 is constructed such that the supply screw 10 and the collection screw 20 have the same rotating speed as in the case of the third or fourth embodiment. The other portions are quite the same as in the cases of the second to fourth embodiments.

In this developing device, when the motor 14 is rotated under the control from the image forming apparatus body side, the collection screw 20 and the supply screw 10 rotate. The rotation of the supply screw 10 and the collection screw 20 circulates the developer in the developer storage tank 50 as in the case of each of the above-described embodiments to thereby supply the developer to the developing roller 18 and collect.

In this circulation of developer, since the upper supply screw 10 has a larger effective area of screw blade than the lower collection screw 20 in the carry-up portion 9, the upper supply screw 10 has stronger conveying ability of developer. For this reason, since the supply screw 10 side is in a slightly negative pressure state in the carry-up portion 9 as in the case of each of the above-described embodiments, the developer conveyed by the collection screw 20 to reach the carry-up portion 9 will be sucked up from above. Accordingly, the carry-up of the developer from the lower stage to the upper stage is smoothly performed against the hindrance of gravity so that the developer does not stagnate in the circulation. On the lower stage side of the carry-up portion 9, the rotating resistance of the collection screw 20 does not increase owing to stagnant developer, nor is any excessive stress applied on the developer.

In this embodiment as described above, since the upper supply screw 10 is adapted to exhibit a stronger conveying force than the lower collection screw 20 by the provision of a difference in effective area between the upper and lower screw blades in the carry-up portion 9, developer is sucked up on the upper stage side in the carry-up portion 9 where developer is carried up from the lower stage to the upper stage so that the carry-up of developer is smoothly performed against the hindrance of gravity. Thus, there is realized an excellent developing device in which stagnant developer in the carry-up portion 9 is prevented, and in which any increase in the necessary driving torque due to increased rotating resistance in the collection screw 20 and deterioration (such as adhesion) due to stress to developer are not caused.

In this respect, this embodiment is only a mere exemplification, and does not restrict the present invention. Accordingly, it is naturally possible to improve and modify the present invention in various ways so long as these are not departed from the gist thereof. In the description of, for example, FIGS. 8 to 11, with the effective area of the upper screw blade as a reference, the center angle, the outer diameter, the shaft diameter or the like of the screw blade are used as means for making the effective area of the lower screw blade smaller than it. However, with the effective area of the lower screw blade as a reference conversely, they may be used as means for making the effective area of the upper screw blade larger than it.

Sixth Embodiment

Figure 17:
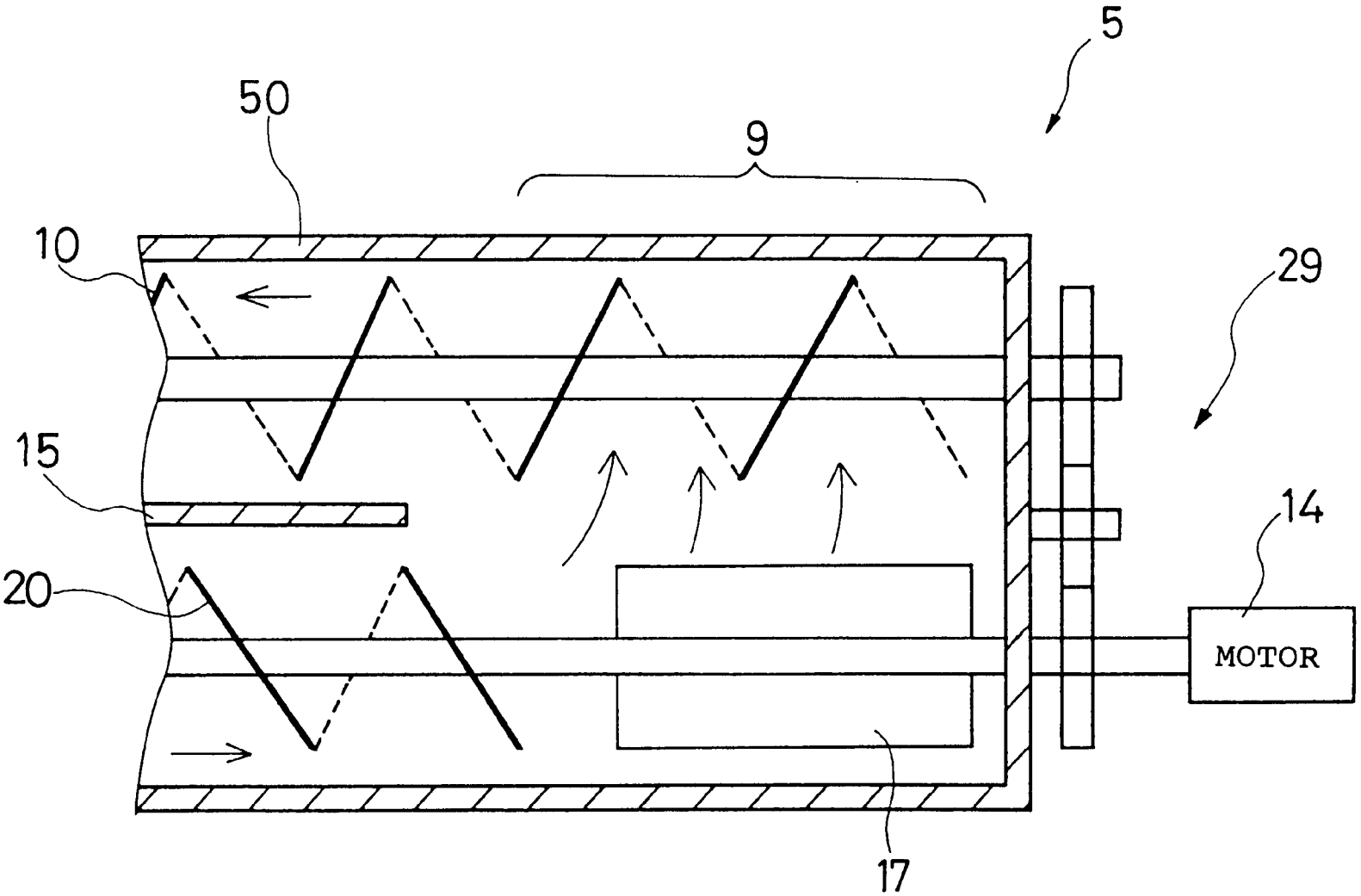
FIG. 17 is an explanatory view for illustrating the structure of a developing device according to a fifth embodiment.
Figure 18:
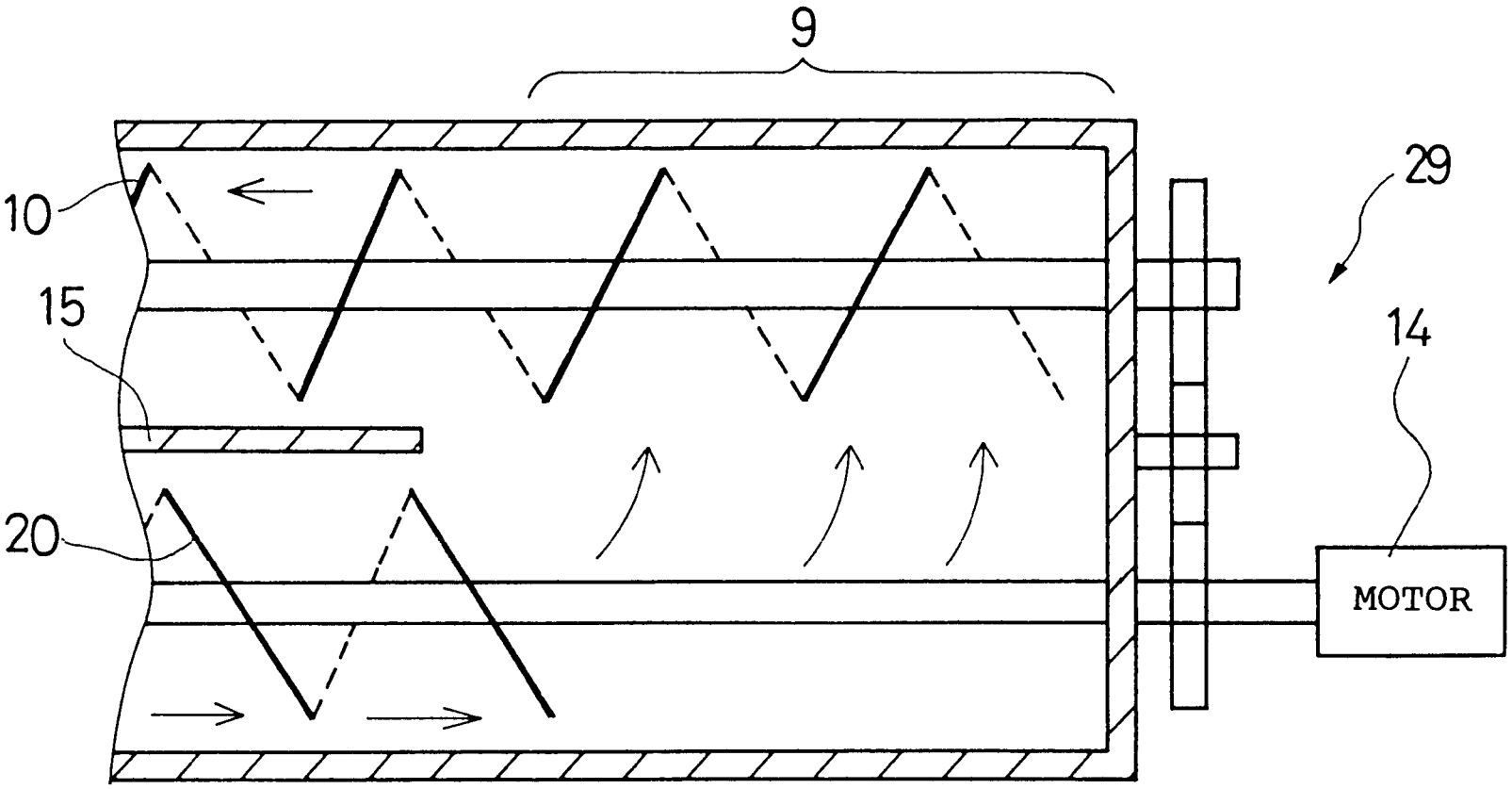
FIG. 18 is an explanatory view for illustrating the structure of a modification example of a developing device according to a sixth embodiment.

This embodiment is structured such that the lower collection screw 20 has no conveying ability in the carry-up portion 9. More specifically, in a developing device according to this embodiment, as the lower collection screw 20, there is provided a blade 17 parallel to the shaft instead of the screw blade in the carry-up portion 9 as shown in FIG. 17, or the lower collection screw 20 may not be provided with any blade in the carry-up portion 9 as shown in FIG. 18. In contrast, the upper supply screw 10 is provided with screw blades. Accordingly, only the upper supply screw 10 has conveying ability while the lower collection screw 20 has no conveying ability in the carry-up portion 9.

In this respect, the gear train 29 is structured such that the supply screw 10 and the collection screw 20 have the same rotating speed as in the cases of the third to fifth embodiments. The other portions are quite the same as in the cases of the second to fifth embodiments.

In this developing device, when the motor 14 is rotated under the control from the image forming apparatus body side, the collection screw 20 and the supply screw 10 rotate. The rotation of the supply screw 10 and the collection screw 20 circulates the developer in the developer storage tank 50 as in the case of each of the above-described embodiments to thereby supply the developer to the developing roller 18 and collect.

In this circulation of developer, since only the upper supply screw 10 has developer conveying ability and the lower collection screw 20 has no conveying ability in the carry-up portion 9, the supply screw 10 side is in a slightly negative pressure state in the carry-up portion 9 as in the case of each of the above-described embodiments so that the developer conveyed by the collection screw 20 to reach the carry-up portion 9 will be sucked up from above. Accordingly, the carry-up of the developer from the lower stage to the upper stage is smoothly performed against the hindrance of gravity so that the developer does not stagnate in the circulation. On the lower stage side of the carry-up portion 9, the rotating resistance of the collection screw 20 does not increase owing to stagnant developer, nor is any excessive stress applied on the developer.

In this embodiment as described above, since only the upper supply screw 10 is adapted to exhibit the developer conveying force in the carry-up portion 9, developer is sucked up on the upper stage side in the carry-up portion 9 where developer is carried up from the lower stage to the upper stage so that the carry-up of developer is smoothly performed against the hindrance of gravity. Thus, there is realized an excellent developing device in which stagnant developer in the carry-up portion 9 is prevented, and in which any increase in the necessary driving torque due to increased rotating resistance in the collection screw 20 and deterioration (such as adhesion) due to stress to developer are not caused. In this respect, this embodiment is only a mere exemplification, and does not restrict the present invention. Accordingly, it is naturally possible to improve and modify the present invention in various ways so long as these are notdeparted from the gist thereof.

Seventh Embodiment

Figure 19:
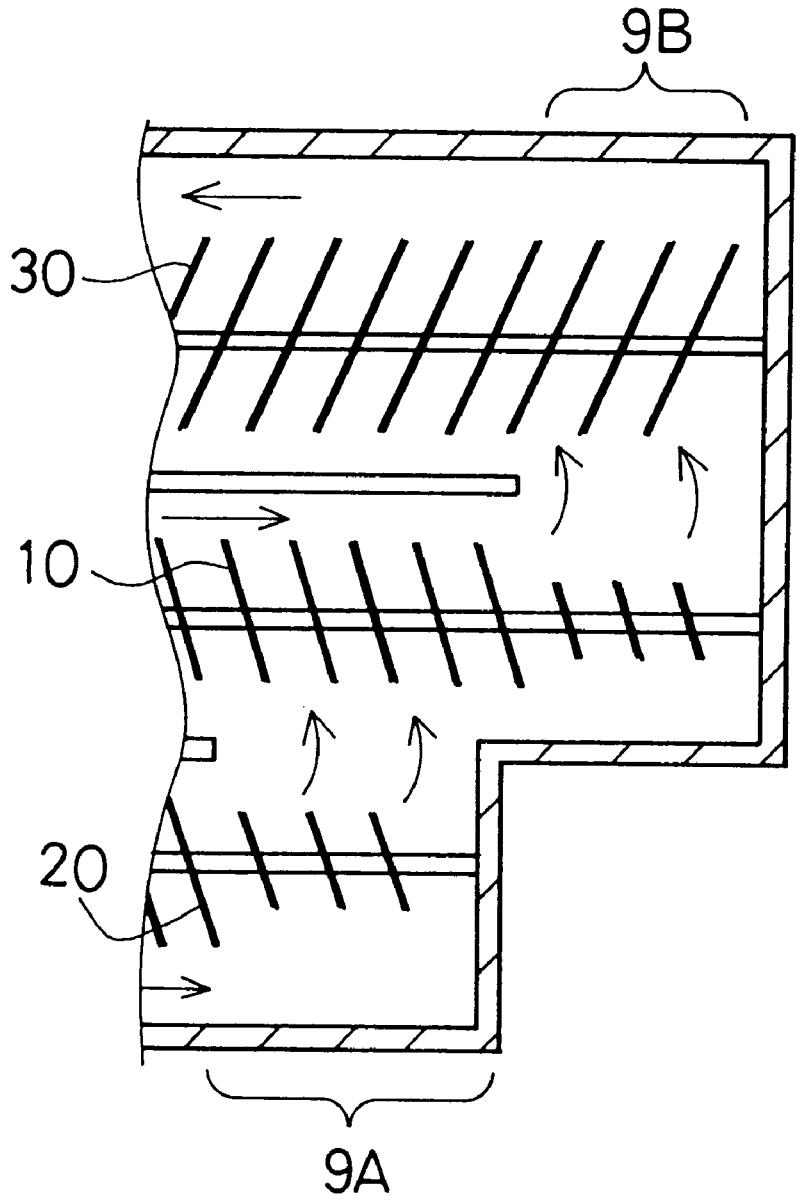
FIG. 19 is an explanatory view for illustrating the structure of a developing device according to a seventh embodiment.

A developing device according to this embodiment is constructed such that three screws, that is, a supply screw 10, a collection screw 20 and an agitation screw 30, are provided in parallel with one another as shown in FIG. 19. These three screws are arranged vertically. More specifically, the agitation screw 30 is positioned on the top stage, the collection screw 20 on the bottom stage, and the supply screw 10 on the intermediate stage respectively. Each screw is rotationally driven by a motor outside the tank, and the motor is adapted to be controlled by the image forming apparatus body side as in the case of each of the above-described embodiments. The conveying directions of developer by each screw are to the right in the figure for the supply screw 10 and the collection screw 20 while to the left in the figure for the agitation screw 30.

In a first carry-up portion 9A, where developer is carried up from the collection screw 20 to the supply screw 10, the lower collection screw 20 is provided with such a screw blade 41B or 41C having a small diameter as shown in FIG. 8. This causes the upper supply screw 10 to exhibit a greater conveying force than the lower collection screw 20 in this portion. Also, in a second carry-up portion 9B, where developer is carried up from the supply screw 10 to the agitation screw 30, the lower supply screw 10 is provided with a screw blade 41B or 41C having a small diameter. This causes the upper agitation screw 30 to exhibit a greater conveying force than the lower supply screw 10 in this portion.

In this developing device, in the first carry-up portion 9A and the second carry-up portion 9B where developer is carried up, the conveying force of the upper screw is stronger than that of the lower screw, and therefore, the upper screw side is in a slightly negative pressure state as in the case of each of the above-described embodiments so that the developer conveyed by the lower screw to reach each carry-up portion 9A, 9B will be sucked up from above. Accordingly, the carry-up of the developer from the lower stage to the upper stage is smoothly performed against the hindrance of gravity so that the developer does not stagnate in the circulation. On the lower stage sides of each carry-up portion 9A and 9B, the rotating resistance of the screw does not increase owing to stagnant developer, nor is any excessive stress applied on the developer.

According to this embodiment as described above, since the upper screw is adapted to exhibit stronger conveying force than the lower screw in each carry-up portion 9A, 9B, developer is sucked up on the upper stage side in each carry-up portion 9A, 9B where developer is carried up from the lower stage to the upper stage so that the carry-up of developer is smoothly performed against the hindrance of gravity. Thus, there is realized an excellent triaxial developing device in which stagnant developer in each carry-up portion 9A, 9B is prevented, and in which any increase in the necessary driving torque due to increased rotating resistance in the screw and deterioration (such as adhesion) due to stress to developer are not caused.

In this respect, this embodiment is only a mere exemplification, and does not restrict the present invention. Accordingly, it is naturally possible to improve and modify the present invention in various ways so long as these are not departed from the gist thereof. For example, means for providing a difference in conveying force between upper and lower screws in each carry-up portion 9A, 9B may be means described in any of the first to sixth embodiments irrespective of the screw diameter. Also, of these means, different means may be adopted between the first carry-up portion 9A and the second carry-up portion 9B.

Eighth Embodiment

Figure 20:
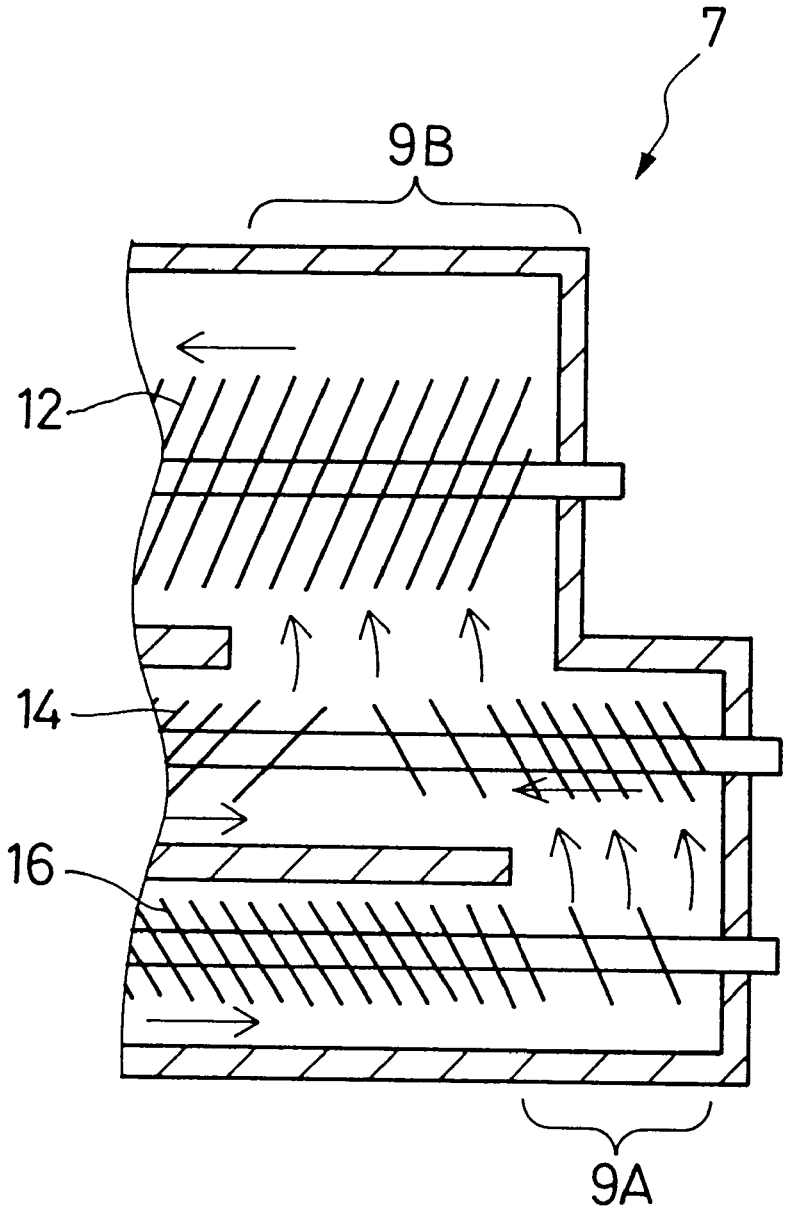
FIG. 20 is an explanatory view for illustrating the structure of a developing device according to an eighth embodiment.

A developing device according to this embodiment is common to the seventh embodiment in that it is a triaxial device in which three screws, that is, a supply screw 10, a collection screw 20 and an agitation screw 30, are arranged in the vertical direction as shown in FIG. 20. In this developing device, however, the first carry-up portion 9A, where developer is carried up from the collection screw 20 to the supply screw 10, is positioned downstream of the second carry-up portion 9B, where developer is carried up from the supply screw 10 to the agitation screw 30, in the conveying direction (to the right in FIG. 20) of the collection screw 20. For this reason, the supply screw 10 in the first carry-up portion 9A has the screw blades which are opposite to those in the other portion thereof in direction.

In the first carry-up portion 9A, where developer is carried up from the collection screw 20 to the supply screw 10, the number of threads in the lower collection screw 20 is made small. This causes the upper supply screw 10 to exhibit a greater conveying force than the lower collection screw 20 in this portion. Also, in the second carry-up portion 9B, where developer is carried up from the supply screw 10 to the agitation screw 30, the number of threads of the lower supply screw 10 is made small. This causes the upper agitation screw 30 to exhibit a greater conveying force than the lower supply screw 10 in this portion.

In this developing device, in the first carry-up portion 9A and the second carry-up portion 9B where developer is carried up, the conveying force of the upper screw is stronger than that of the lower screw, and therefore, the upper screw side is in a slightly negative pressure state as in the case of each of the above-described embodiments so that the developer conveyed by the lower screw to reach each carry-up portion 9A, 9B will be sucked up from above. Particularly, the developer which has been conveyed by the supply screw 10 to the right in FIG. 20 is sucked up by the upper agitation screw 30 in the second carry-up portion 9B, and does not reach the first carry-up portion 9A. For this reason, the developer is not concentrated on the upper supply screw 10 in the first carry-up portion 9A, but is further smoothly carried up. Accordingly, the carry-up of the developer from the lower stage to the upper stage is smoothly performed against the hindrance of gravity so that the developer does not stagnate in the circulation. On the lower stage sides of each carry-up portion 9A, 9B, the rotating resistance of the screw does not increase owing to stagnant developer, nor is any excessive stress applied on the developer.

According to this embodiment as described above, since the upper screw is adapted to exhibit a stronger conveying force than the lower screw in each carry-up portion 9A, 9B, developer is sucked up on the upper stage side in each carry-up portion 9A, 9B where developer is carried up from the lower stage to the upper stage. Also, since the first carry-up portion 9A is arranged downstream of the second carry-up portion 9B in the conveying direction of the collection screw 20, the concentration of the developer on the upper stage side in the first carry-up portion 9A is excluded. Therefore, the carry-up of developer is smoothly performed against the hindrance of gravity. Thus, there is realized an excellent triaxial developing device in which stagnant developer in each carry-up portion 9A, 9B is prevented, and in which any increase in the necessary driving torque due to increased rotating resistance in the screw and deterioration (such as adhesion) due to stress to developer are not caused.

In this respect, this embodiment is only a mere exemplification, and does not restrict the present invention. Accordingly, it is naturally possible to improve and modify the present invention in various ways so long as these are not departed from the gist thereof. For example, means for providing a difference in conveying force between upper and lower screws in each carry-up portion 9A, 9B may be means described in any of the first to sixth embodiments irrespective of the number of threads of screw. Also, of these means, different means may be adopted between the first carry-up portion 9A and the second carry-up portion 9B.

Ninth Embodiment

Figure 21:
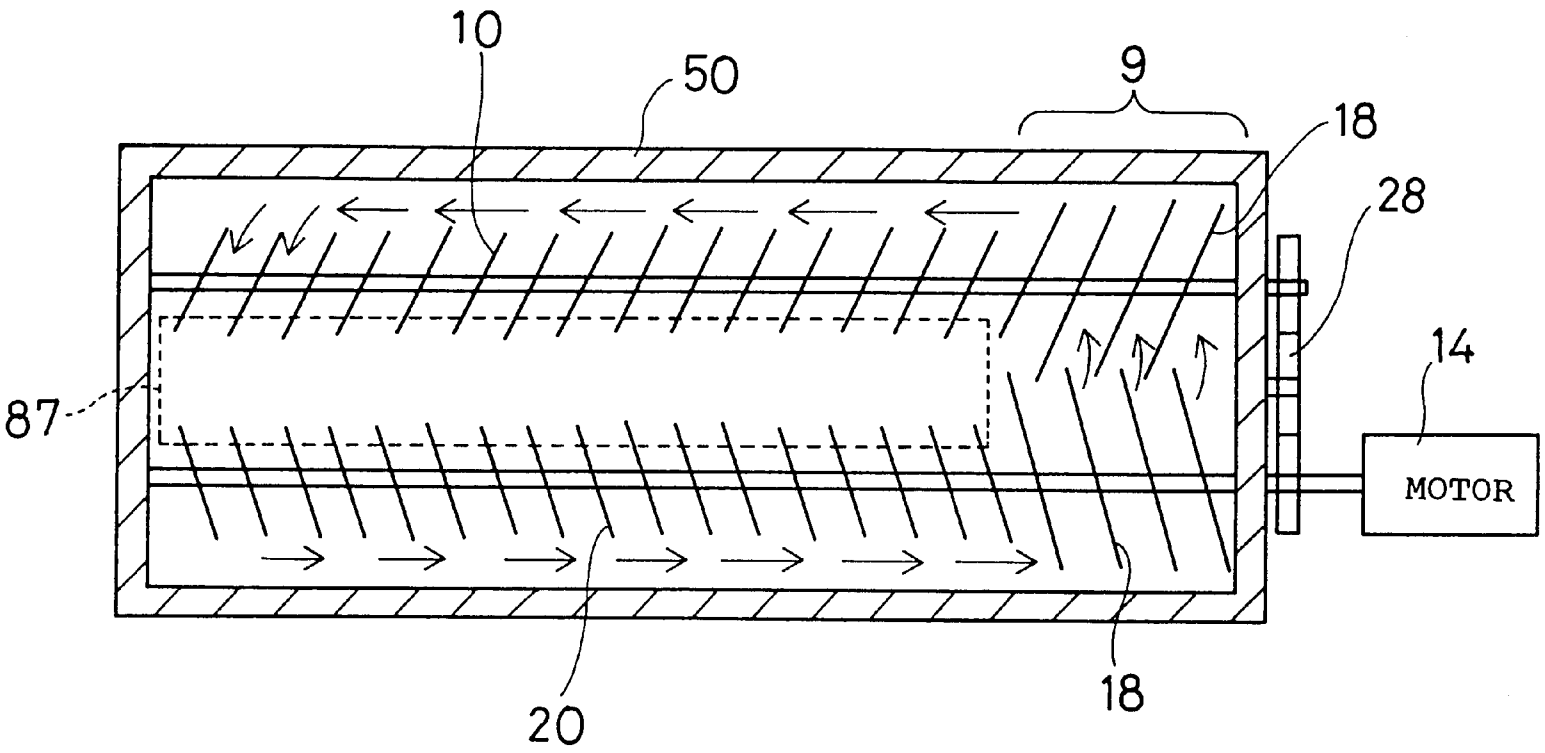
FIG. 21 is an explanatory view for illustrating the structure of a developing device according to a ninth embodiment.

A developing device according to this embodiment is constructed such that two screws, that is, a supply screw 10 (second screw) and a collection screw 20 (first screw), are provided in parallel to each other within a developer storage tank 50 for containing developer as shown in FIG. 21. Both screws 10 and 20 are coupled to each other through a gear train 28 outside the developer storage tank 50. Further, the collection screw 20 is provided with a motor 14 controlled by the image forming apparatus body side.

Within the carry-up area 9 in this developing device, the supply screw 10 and the collection screw 20 are provided with screw blades 18 each having a larger diameter than in the other portions. The ranges in the supply screw 10 and the collection screw 20, within which the screw blades 18 each having the larger diameter are provided both extend over the substantially entire carry-up area 9. For this reason, the ranges of the screw blades 18 in both screws 10 and 20 overlap with each other in the axial direction.

This developing device operates as follows: when the motor 14 is rotated under the control from the image forming apparatus body side, the collection screw 20 rotates. Since the rotation is transmitted to the supply screw 10 through the gear train 28, the supply screw 10 also rotates. Thereby, developer is circulated in the counterclockwise direction in FIG. 21 while it is being agitated within a developer storage tank 50. With this circulation, developer is supplied to the developing roll 87 from the supply screw 10. This causes the developing roll 87 to impart toner to an electrostatic latent image on a photosensitive drum 90 for development. Surplus developer on the developing roll 87 is collected by the collection screw 20.

In such circulation of developer, the developer conveyed to the right by the collection screw 20 gradually increases by means of the collection from the developing roll 87, and reaches the carry-up area 9. The developer reached the carry-up area 9 is carried up by the upper supply screw 10, and thereafter is conveyed in the opposite direction by the supply screw 10 to continue the circulation. Also, the developer conveyed to the left by the supply screw 10 gradually decreases because it is supplied to the developing roll 87, but some developer reaches the downstream end portion. Such developer falls down by gravity whereby it is delivered to the collection screw 20 to continue the circulation.

The carry-up of developer to the supply screw 10 from the collection screw 20 in the carry-up area 9 will be described in more detail. The developer which reached the carry-up area 9 strikes against the inner wall of the developer storage tank 50, and cannot further advance to the right in FIG. 21. Since, however, the following developer is conveyed by the collection screw 20, it overflows upwardly. By this overflowing, the developer, which reaches the position where it is subjected to the conveying force of the supply screw 10, thereafter advances to the left in FIG. 21 by the supply screw 10. Thus, the developer is carried up from the collection screw 20 to the supply screw 10.

Since the supply screw 10 and the collection screw 20 within the carry-up area 9 are provided with screw blades 18 and 18 each having a larger diameter than in the other portions respectively, the distance between the collection screw 20 and the supply screw 10 is noticeably short, and the developer, which overflows above the collection screw 20, is immediately caught in the supply screw 10 to be subjected to the conveying force thereof. For this reason, the carry-up of the developer in the carry-up area 9 is very smoothly performed. Accordingly, the developer does not stagnate in the carry-up area 9, but is circulated smoothly. Thereby, the rotating resistance of the collection screw 20 and the supply screw 10 (particularly the collection screw 20) does not increase, nor is any excessive stress applied on the developer within the carry-up area 9.

As described in detail above, in a developing device according to this embodiment, of the supply screw 10 and the collection screw 20, the portions within the carry-up area 9 are provided with screw blades 18 and 18 each having a larger diameter than in the other portions respectively to make the distance between the collection screw 20 and the supply screw 10 noticeably short, and therefore, the developer which overflows above the collection screw 20 is immediately subjected to the conveying force of the supply screw 10. In other words, the developer is noticeably smoothly carried up from the collection screw 20 to the supply screw 10 and stagnation of the developer in the carry-up area 9 is excluded, and therefore, there is realized a developing device in which the necessary driving torque does not increase even if the rotating resistance of the collection screw 20 and the supply screw 10 (particularly collection screw 20) increases. Also, there is realized a developing device in which deterioration (such as adhesion) is not caused because of excessive stress applied on the developer within the carry-up area 9.

The ranges, in which the supply screw 10 and the collection screw 20 are provided with screw blades 18 and 18, each having the larger diameter respectively, have been provided over the substantially entire carry-up area 9, and therefore, the ranges of the screw blades 18 in both screws 10 and 20 overlap with each other in the axial direction, and the developer, which overflows upwardly from the collection screw 20 (range of screw blade 22), is reliably caught in the supply screw 10 (range of screw blade 17), thus realizing a developing device in which the carry-up is satisfactorily performed.

In this respect, this embodiment is only a mere exemplification, and does not restrict the present invention. Accordingly, it is naturally possible to improve and modify the present invention in various ways so long as these are not departed from the gist thereof. For example, a vertical developing device in which the supply screw 10 and the collection screw 20 are arranged up and down is applicable to a horizontal developing device. Also, a triaxial type developing device provided with an agitation screw mainly serving to agitate developer in addition to the supply screw and the collection screw may be used, and in this case, the embodiment is also applicable to the delivery area from the supply screw to the agitation screw.

Also, in a developing device, the ranges, in which the supply screw 10 and the collection screw 20 are provided with screw blades 18 and 18, each having the larger diameter, have been provided over the substantially entire carry-up area 9, and such a range may be provided at part within the carry-up area 9. In this case, both ranges are preferably overlapped in the axial direction. However, this is not indispensable.

Tenth and Eleventh Embodiments

Figure 22:
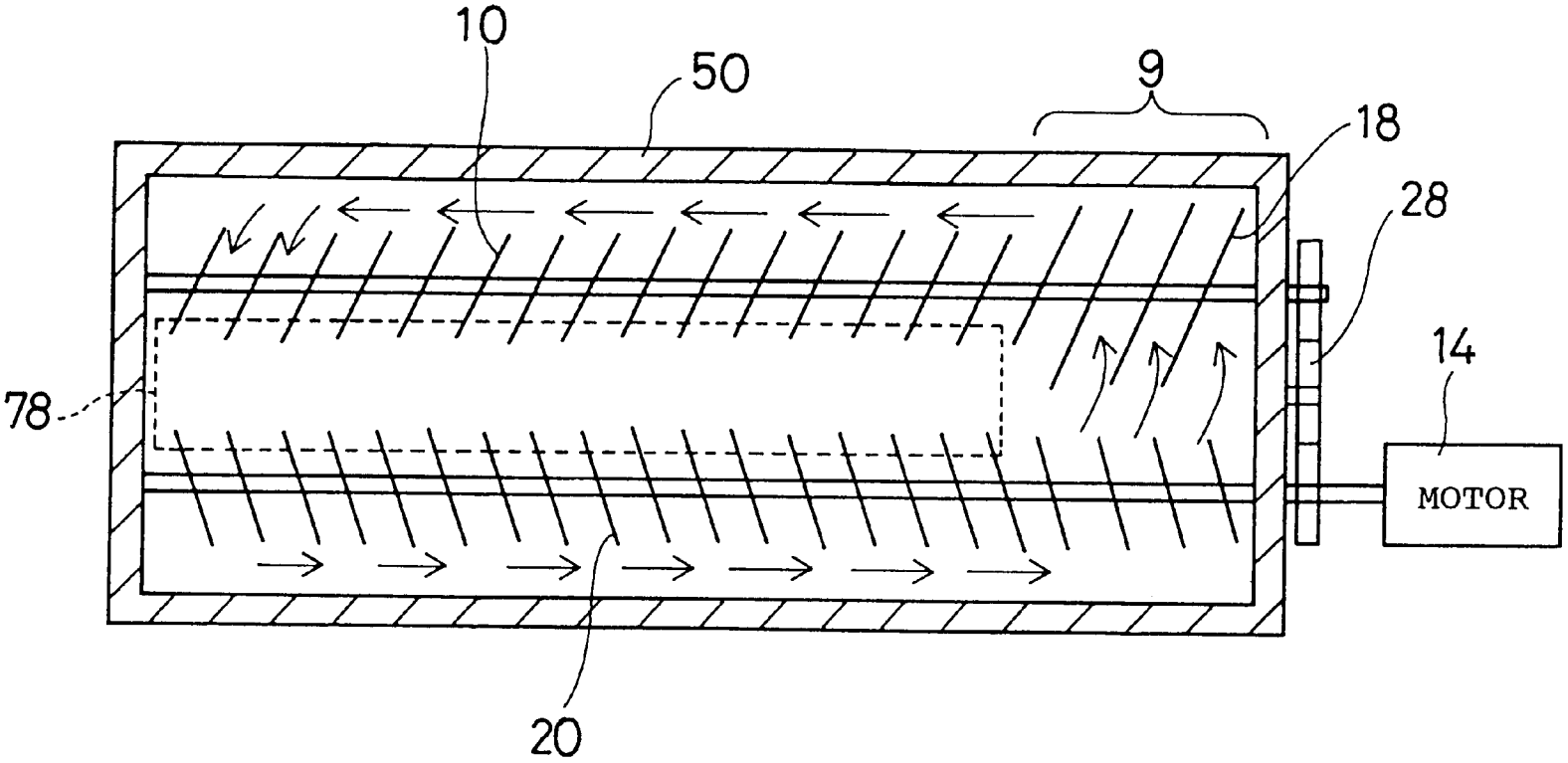
FIG. 22 is an explanatory view for illustrating the structure of a developing device according to a tenth embodiment.
Figure 23:
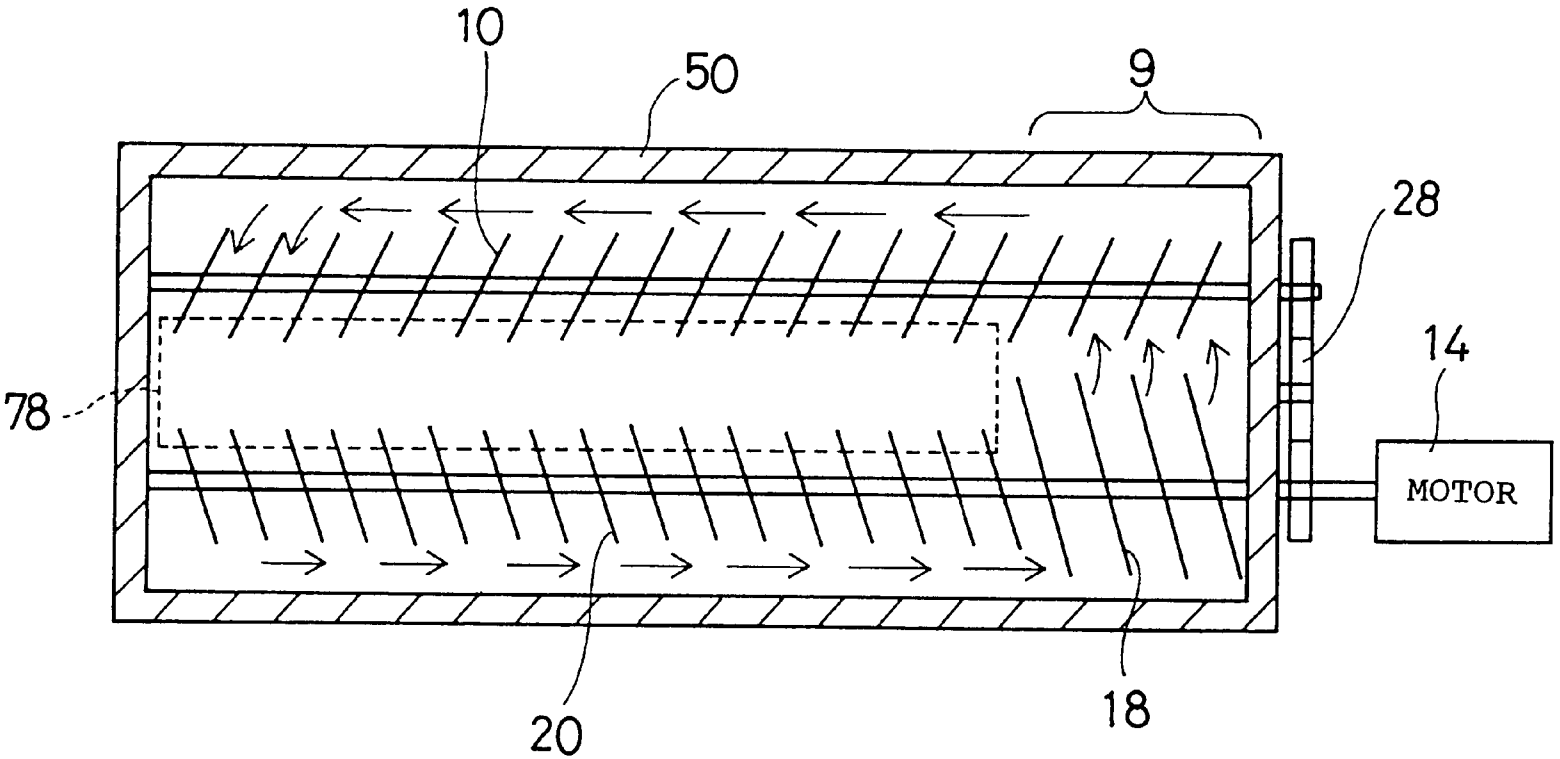
FIG. 23 is an explanatory view for illustrating the structure of a developing device according to a eleventh embodiment.

As shown in FIG. 22, structure of a developing device according to tenth embodiment is basically same as that of a developing device according to ninth embodiment. More specifically, a large diameter screw blade 18 is equipped with a supply screw 10 within carry-up area 9 while not equipped with a collection screw 20. This point differs from a ninth embodiment. As shown in FIG. 23, the other way about a developing device according to tenth embodiment, a large diameter screw blade 18 is equipped with a collection screw 20 within carry-up area 9 of a developing device according to eleventh embodiment while not provided with a supply screw 10. Not to mention, other parts of a tenth embodiment is same as those of a developing device according to ninth embodiment.

Developing devices according to tenth and eleventh embodiments operate almost same as a developing device according to ninth embodiment. That is, drive by a motor 14 rotates a supply screw 10 and a collection screw 20 so that developer can circulate in a developer storage tank 50. Then the developer is supplied to a developing roll 87 from a supply screw 10 and surplus developer is collected into collection screw 10. Developer is carried up to a supply screw 10 from collection screw 20 in carry-up area 9. Developer circulation of this way is same as the developer circulation according to ninth embodiment.

Since a supply screw 10 (for a developing device) or a collection screw 20 (for a developing device) equips a large diameter screw blade 18 within carry-up area 9, the distance between a collection screw 20 and a supply screw 10 becomes short and developer is carried up smoothly. Therefore, developer circulates smoothly without stagnation in carry-up area 9. The smooth rotation prevents resistance of a collection screw 20 and a supply screw 10, especially of a collection screw 20, from getting greater and therefore, developer in carry-up area 9 becomes free from extreme stress.

Since developing devices according to tenth and eleventh embodiments equip larger diameter screw blades 18 with either a supply screw 10 or a collection screw 20 to make the distance between a collection screw 20 and a supply screw 10 short, developer is carried up from a collection screw 20 to a supply screw 10 smoothly, though not as apparent as the aspect of a ninth embodiment, and stress to driving torque of a screw and developer is lessened.

Twelfth to Fourteenth Embodiments

Figure 24:
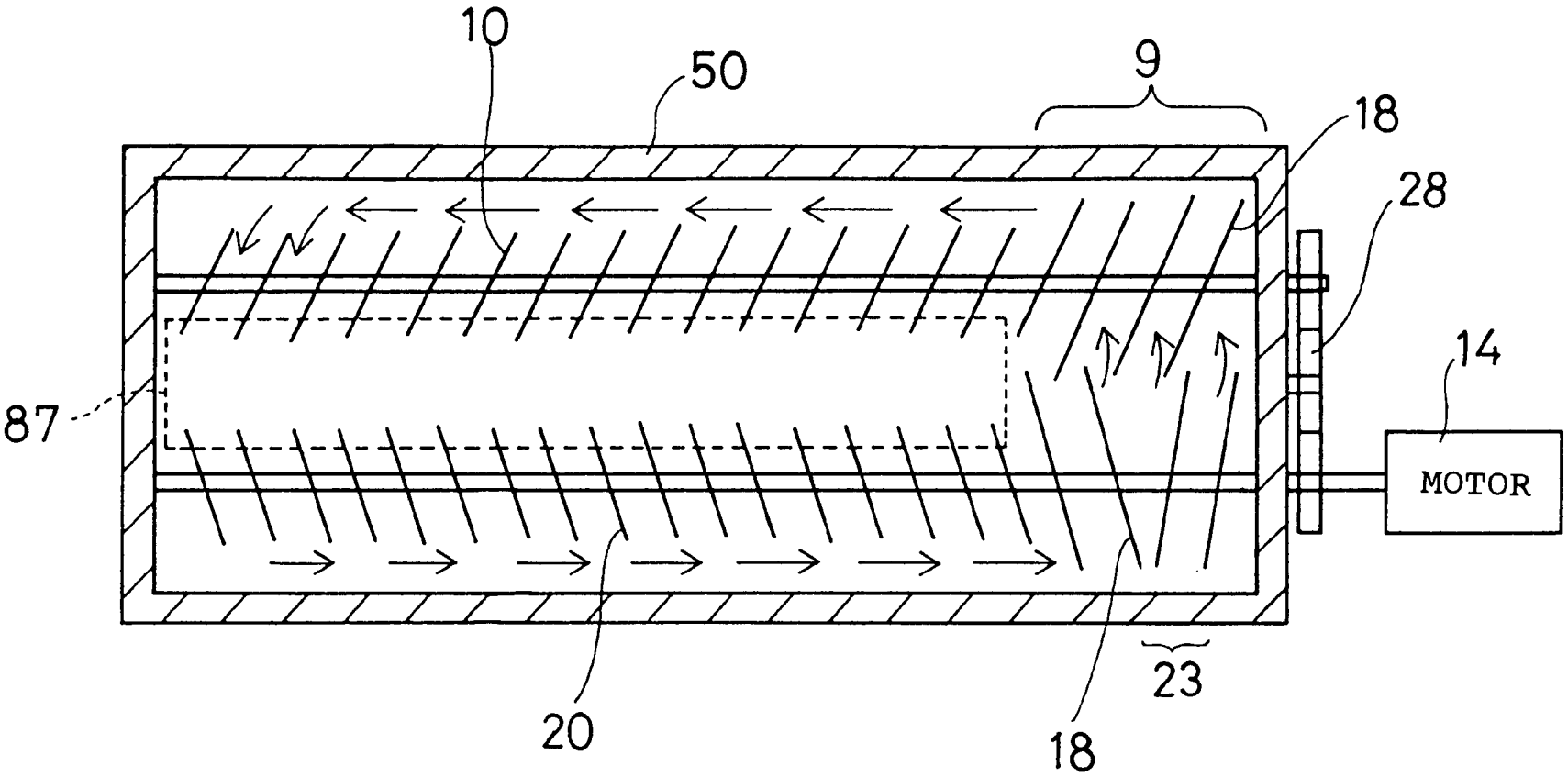
FIG. 24 is an explanatory view for illustrating the structure of a developing device according to a twelfth embodiment.
Figure 25:
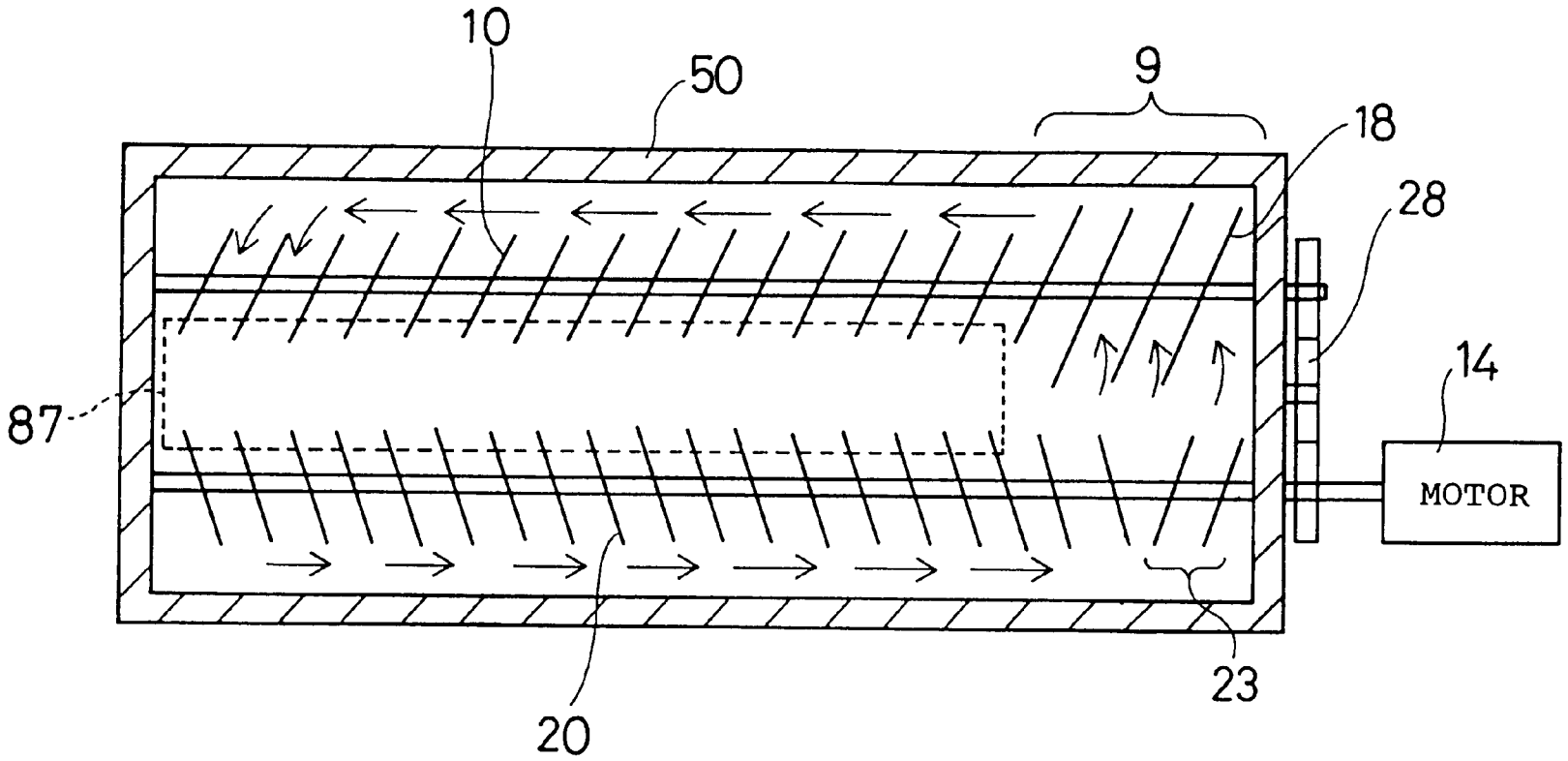
FIG. 25 is an explanatory view for illustrating the structure of a developing device according to a thirteenth embodiment.
Figure 26:
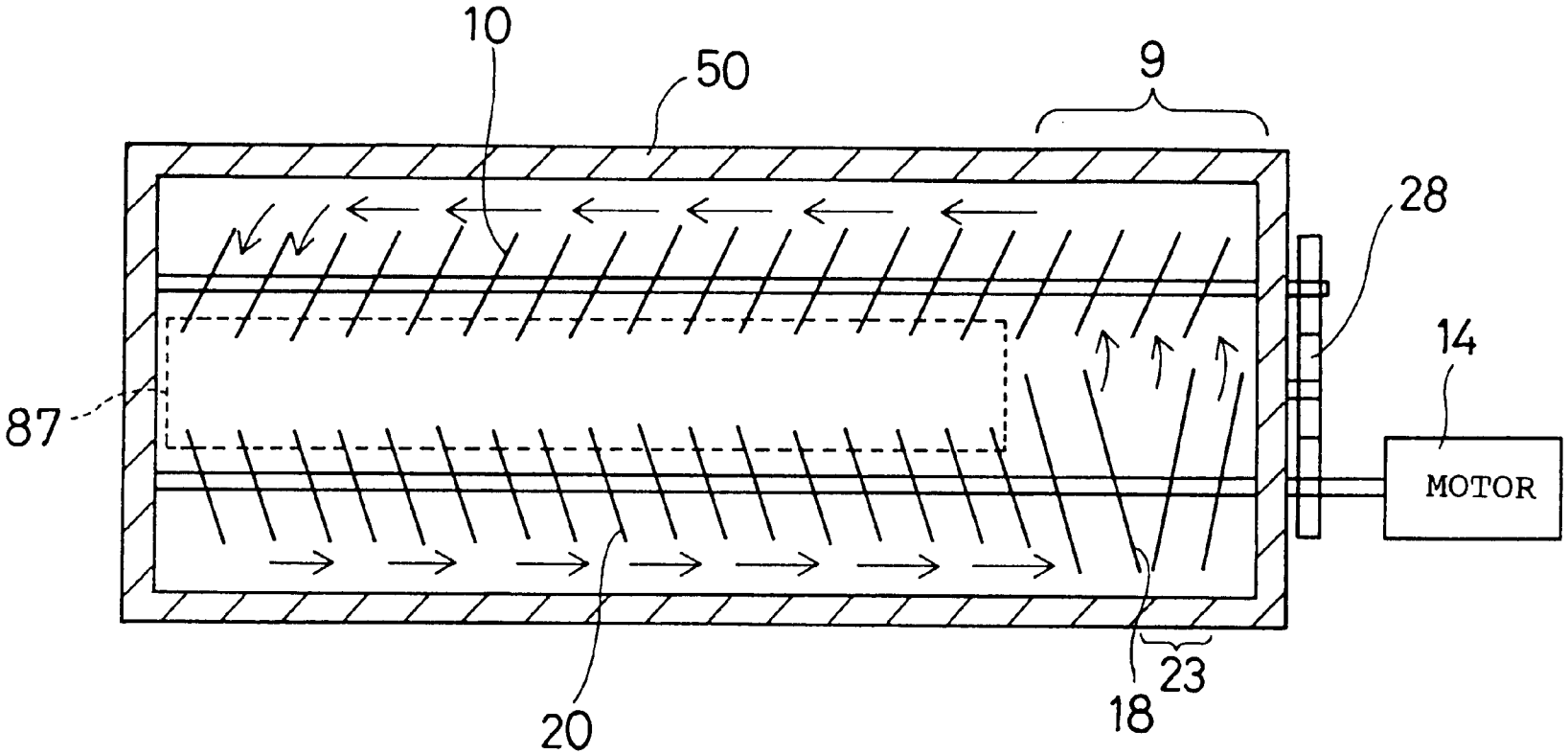
FIG. 26 is an explanatory view for illustrating the structure of a developing device according to a fourteenth embodiment.

A developing device according to twelfth embodiment, as shown in FIG. 24, basic structure of the device is same as a developing device according to embodiment 9. More specifically, the only difference between the devices according to twelfth and ninth embodiments is that the device according to twelfth embodiment has reverse rolling area 23 at the far downstream of carry-up area 9 where screw blades are attached in reverse direction of other screw blades. Other than screw blades attached in reverse direction, other parts of the device according to twelfth embodiment are same as the device according to ninth embodiment. A reverse rolling area 23 occupies almost right half of carry-up area 9 for a collection screw 20 in FIG. 24. A developing device according to thirteenth embodiment, as shown in FIG. 25, basic structure of the device is same as a developing device according to tenth embodiment and the device applies a reverse rolling area 23 similar to the one in twelfth embodiment. A developing device according to fourteenth embodiment, as shown in FIG. 26, basic structure of the device is same as a developing device according to eleventh embodiment and the device applies a reverse rolling area 23 similar to the one in twelfth embodiment.

Having a reverse rolling area 23 within carry-up area 9, developing devices according to twelfth to fourteenth embodiments bring the following effect. That is, because developer is conveyed by a collection screw in reverse direction (leftward in FIGS.) at reverse rolling area 23, the developer which is conveyed by a collection screw 20 and reaches a carry-up area 9 concentrates at the approximate center of the carry-up area. Because of the concentration at the carry-up area, the amount of developer overflowing becomes larger. Therefore, developer is more smoothly carried up from a collection screw 20 to a supply screw 10. Additionally, control of driving torque for a screw and stress to developer is more improved than a device without reverse rolling area 23.

Fifteenth Embodiment

Figure 27:
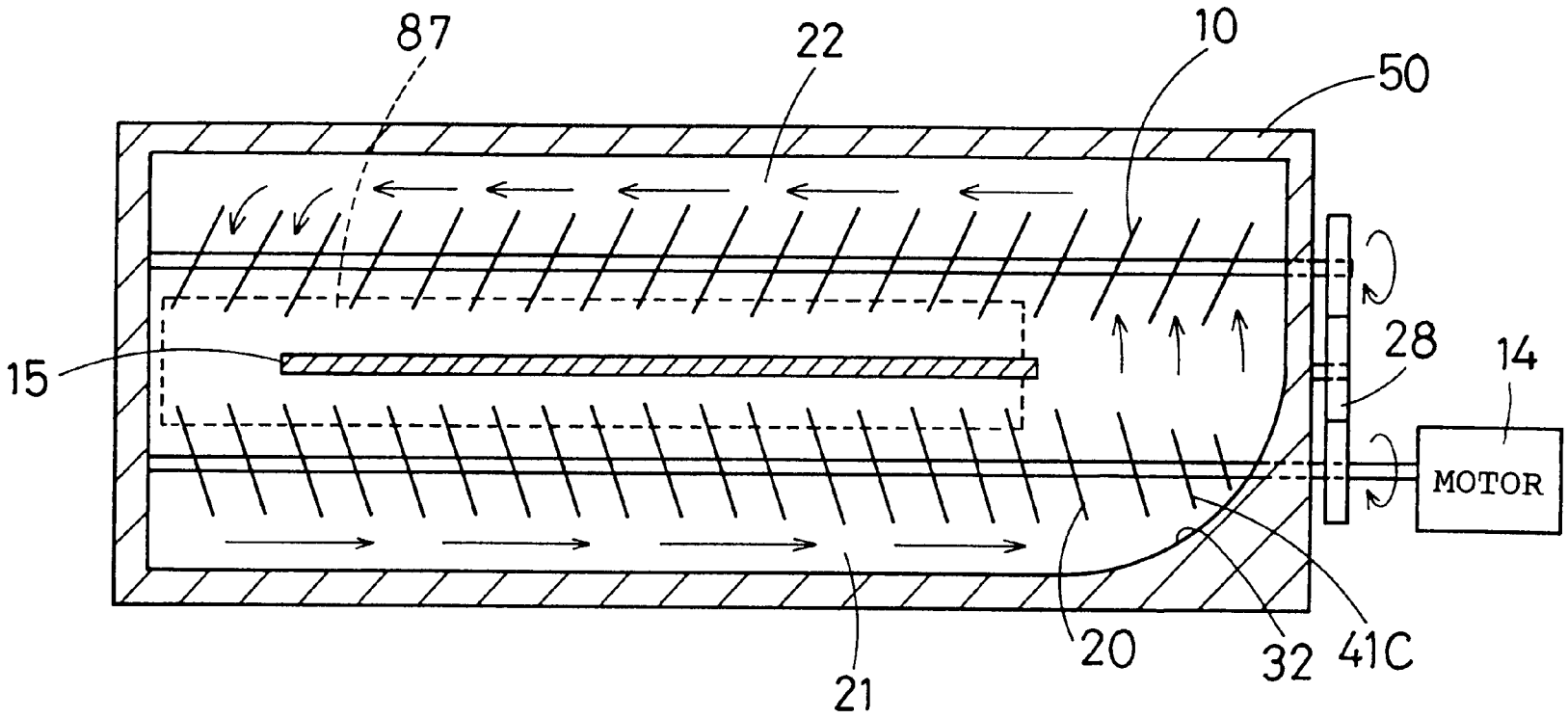
FIG. 27 is an explanatory view for illustrating the structure of a developing device according to a fifteenth embodiment.

A developing device according to this embodiment, as shown in FIG. 27, has a developer storage tank 50 in which a collection screw 10 and a supply screw 20 are arranged vertically. A collection screw 10 and a supply screw 20 are arranged in parallel. These screws connect a motor 14 and gear row 28 attached outside of the developer storage tank 50 and receive rotate driving from the motor 14. A partition wall 15, a part of a developer storage tank 50, forms between a collection screw 10 and a supply screw 20. A part above the partition wall 15 in the developer storage tank 50 forms flowing path 22 where developer is conveyed leftward in FIG. 27 by a supply screw 10. Vice versa, a part below the partition wall 15 forms flowing path 21 where developer is conveyed rightward in FIG. 27 by a collection screw 20.

As to inner surface of the developer storage tank 50, there is a curved surface part 32 at downstream end of conveying direction, rightward in FIG. 27, for a collection screw 20. The curved surface part 32 is located opposite to a supply screw 10 beyond a supply screw 10. Therefore, a flowing path 21 below a partition wall 15 is a little narrower around the downstream end of the flowing direction. At the downstream end, smaller diameter screw blade 41C, that is, a screw blade with smaller effective area, is attached on a screw shaft 13. Therefore, the conveying force of a collection screw(rightward in FIG. 27) is smaller at the downstream end than at other area.

A developing device with afore-mentioned structure operates as follows. When a motor 14 rotates a collection screw 20 and a supply screw 10, the collection screw 20 conveys the developer around flowing path 21 and the supply screw 10 conveys the developer around flowing path 22 toward conveying direction for each screw. Because conveying direction of each screw is opposite to each other's, developer circulates around a partition wall 15 which is inside of a developer storage tank 50, as indicated with arrows in FIG. 27. Developer circulates like that and then, through upper side of flowing path 22, developer is given onto a developer carrier roller 87 to develop an electrostatic latent image on a photosensitive drum 94. Surplus developer on the developer carrier roller 87 is collected to the bottom of flowing path 21. Then, the developer circulates within the developer storage tank 50 again.

The detailed movement for the developer to reach the downstream end of lower flowing path 21 is explained as follows. Developer in flowing path 21 flows rightward in FIG. 27 with conveying operation. When the developer reaches downstream end, it overflows to the upper flowing path 22. Gravity acts toward the opposite direction of the overflow flowing from bottom to top at the upper side. On the other hand, because flowing path 21 is narrow at the curved surface part 32 to curve the flow of developer upward, developer easily moves up to the upper flowing path 22 at the downstream end of lower flowing path 21. Curved surface part 32 is free from a space where stagnation occurs so that developer can circulate smoothly.

At downstream end where direction of developer flow is switched, both gravity acting on developer which has moved to upper flowing path 22 and the force by developer pushed out from back tend to generate bigger stress. Because a screw blade 41C at the most stressful part is smaller than other screw blades to weaken conveying force, stress does not get much greater. Therefore, the structure prevents developer from deterioration such as adhesion at downstream end and also saves driving torque of a motor 14. Developer which has moved to upper flowing path 22 is conveyed leftward in FIG. 27 by a supply screw 10.

Developer which has reached downstream end of the upper flowing path 22 falls because of gravity and moves to the lower flowing path 21. Therefore, measures to apply curved surface and to attach smaller screw blades for downstream end of flowing path 21 is not necessary.

As described in detail above, developing device according to this embodiment applies curved surface part 32 as well as attaches a screw blade 41C which is smaller than others at downstream end of lower flowing path 21 where gravitation force hinders developer's movement. Therefore, the developer which has reached the downstream end does not stagnate, but changes its flowing directions against gravitation force and easily moves to upper flowing path 22 without big stress. Because the curved surface and smaller screw blades prevent developer from rough circulation as well as deterioration by stress, it enable a developer to securely develop a photosensitive drum via a developer carrier roller 87 with small driving torque. Device of this embodiment is suitable for a full-color image forming device because the device can deal a color developer without deterioration: it is said that a color developer tends to deteriorate more easily than black developer. Also, because this developing device is horizontal type and requires narrow width, the device is suitable for the use of developing unit of image forming unit for each color of tandem type full color image forming device.

Sixteenth Embodiment

Figure 28:
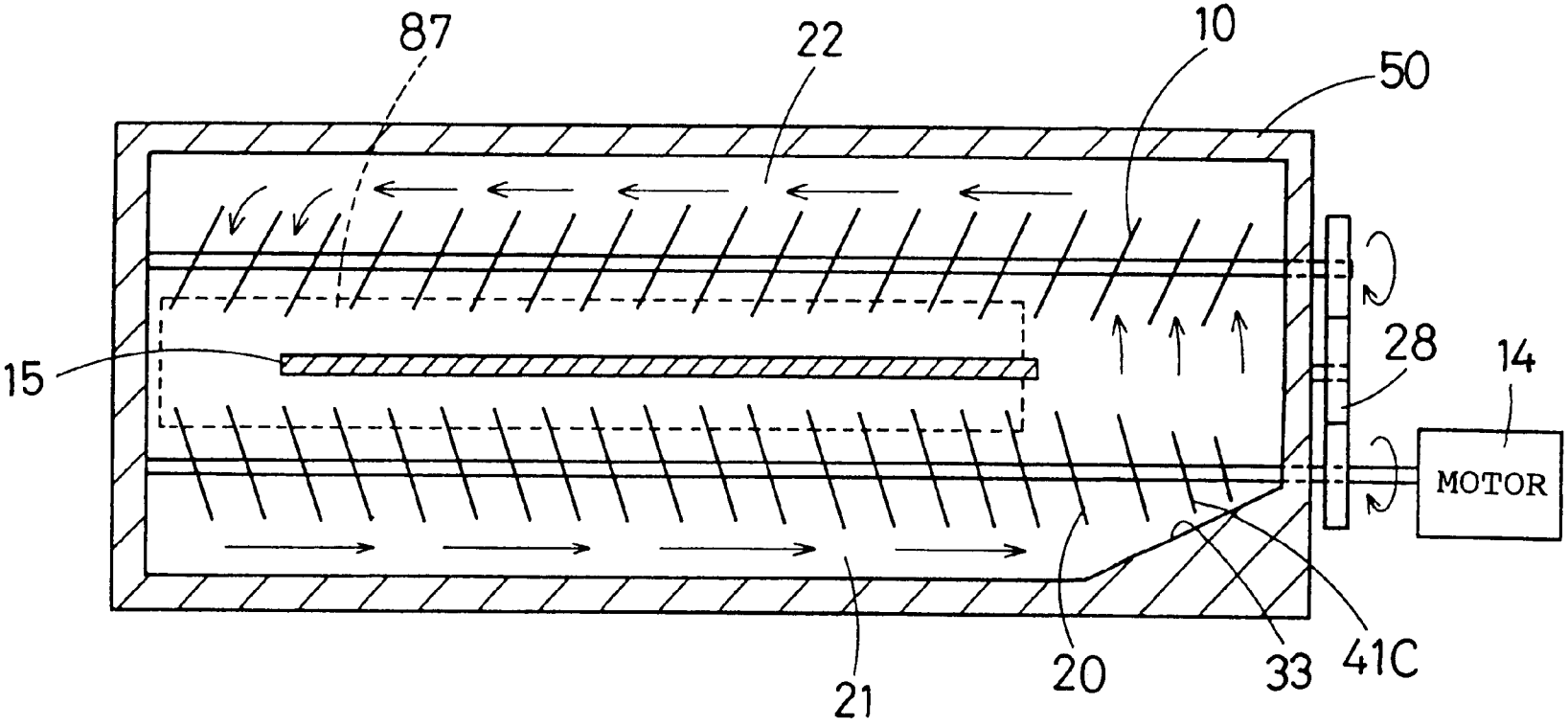
FIG. 28 is an explanatory view for illustrating the structure of a developing device according to a sixteenth embodiment.

A developing device according to sixteenth embodiment, as shown in FIG. 28, applies tapered surface 33 instead of curved surface 32 for a developing device according to fifteenth embodiment at lower flowing path 21. This is the only difference between fifteenth embodiment and sixteenth embodiment. Other than this point, there is no difference between them. Similar to the fifteenth embodiment, applying tapered surface also makes the lower flowing path 21 a little narrower at its downstream side. Because of the narrower flowing path, when a motor 14 drives to make developer circulate, similar to the fifteenth embodiment, developer flow at downstream end of lower flowing path 21 is curved upward and therefore, developer easily moves to the upper flowing path 22 against gravity. Also, there is no space where stagnation occurs. That is, similar to the fifth embodiment, the tapered surface prevents developer from being stagnated so that developer can circulate smoothly and get developed. A miniaturized vertical developing device is embodied in this embodiment.

The present invention is not restricted to these embodiments. It is naturally possible to improve and modify the present invention in various ways so long as these are not departed from the gist thereof. For example, the fifteenth and sixteenth embodiments provide small diameter screw blade 41C to a collection screw 20 at downstream end of lower flowing path 21 so as to lessen the screw blade's effective area and conveying force at this section. Other than this, a bigger diameter screw shaft or screw blades with modified shape may be equipped with the screw so as to lessen the screw blade's effective area. Modification of screw blade angle or pitch may also be applied so as to lessen conveying force at the section. On the other hand, bigger screw blades may be applied to a certain section of a supply screw 10 for upper side where the section faces less conveying force section of the collection screw so as to increase conveying force. This brings a better result. Furthermore, curved surface 32, tapered surface 33 or a small diameter screw 41C may be applied to downstream end of the upper flowing path 22, though the embodiments apply such items only to downstream end of the lower flowing path 21.

Figure 29:
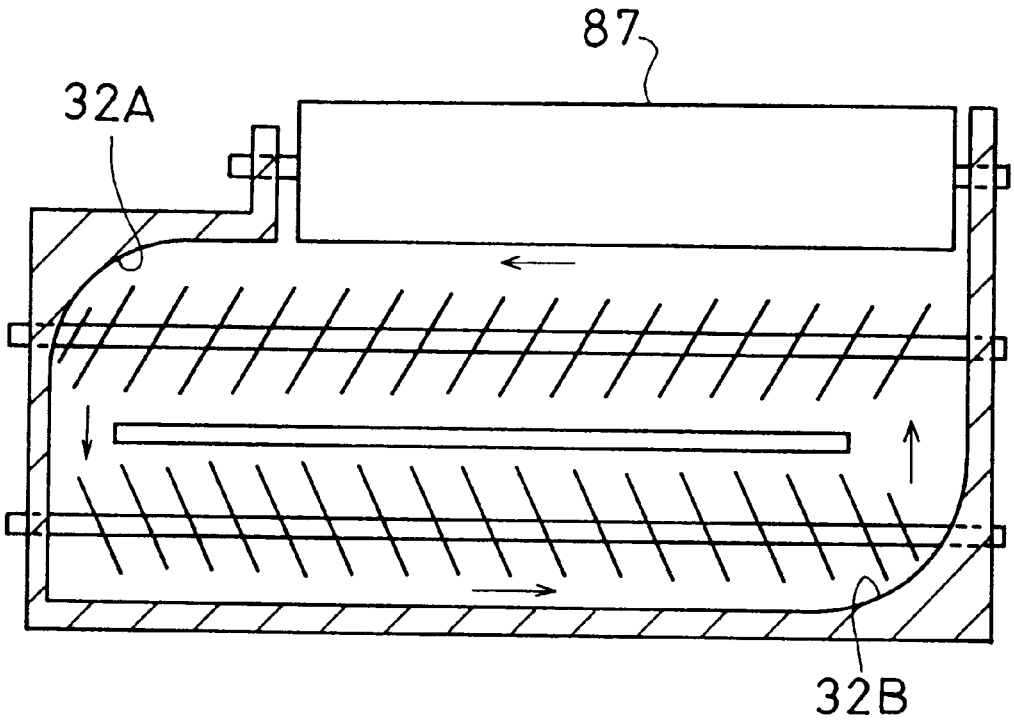
FIG. 29 is an example view when an aspect of a fifteenth embodiment is applied to a horizontal developing device.
Figure 30:
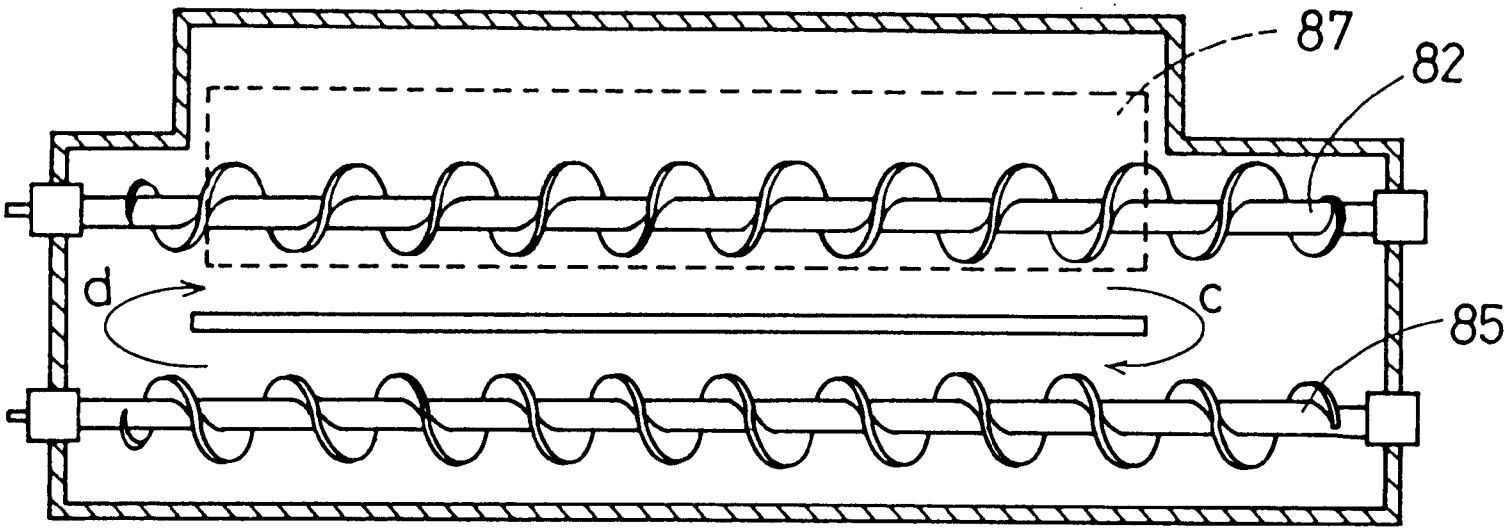
PRIOR ART FIG. 30
FIG. 30 is an explanatory view for illustrating the structure of a conventional developing device.

Though aspects of both fifteenth and sixteenth embodiments are applied to a vertical type developing device with up-and-down arranged two screws, these aspects are applicable to a horizontal type developing device with left-and-light arranged two screws. For the horizontal type developing device, curved surface part 32A, 32B (or tapered surface) may be applied to downstream end of both flowing paths as shown in Fig.29, or to one of them. Furthermore, the present invention works irrespective of single element, or two elements developer.

What is claimed is:

1. A developing device comprising a first screw and a second screw to convey developer in axial direction, wherein as to at least one of the first screw and the second screw, conveying force of developer is different at the upstream side and downstream side in conveying direction so that the depth of developer within the screw becomes uniform irrespective of the position in the axial direction.

2. A developing device according to claim 1, wherein said second screw is a supply screw which conveys developer in axial direction and then supplies developer for a developing roll, and said first screw is a collection screw which collects the developer on said developing roll and conveys the developer in axial direction.

3. A developing device according to claim 2, wherein conveying force by said supply screw is greater at upstream side than at downstream side for conveying direction.

4. A developing device according to claim 2, wherein conveying force by said collection screw is greater at downstream side than at upstream side for conveying direction.

5. A developing device according to claim 2, wherein effective conveying area of screw blade for the screws, in at least one of said supply screw and said collection screw, is different at downstream side and upstream side for conveying direction.

6. A developing device according to claim 5, wherein outer diameter of screw blade for screws, in at least one of said supply screw and said collection screw, is different at downstream side and upstream side for conveying direction.

7. A developing device according to claim 5, wherein center angle of screw blade for screws, in at least one of said supply screw and said collection screw, is different at downstream side and upstream side for conveying direction.

8. A developing device according to claim 5, wherein shaft diameter of screw blade for screws, in at least one of said supply screw and said collection screw, is different at downstream side and upstream side for conveying direction.

9. A developing device according to claim 5, wherein notch size of screw blade for screws, in at least one of said supply screw and said collection screw, is different at downstream side and upstream side for conveying direction.

10. A developing device according to claim 2, wherein pitch of screw blade for screws, in at least one of said supply screw and said collection screw, is different at downstream side and upstream side for conveying direction.

11. A developing device according to claim 2, wherein the number of threads of screw blade for screws, in at least one of said supply screw and said collection screw, is different at downstream side and upstream side for conveying direction.

12. A developing device according to claim 2, wherein at least one of said supply screw and said collection screw has a member to hinder developer from being conveyed.

13. A developing device according to claim 2, wherein said supply screw is arranged above said collection screw.

14. A developing device comprising a first conveying means and a second conveying means, wherein conveying force by receiving side's conveying means is made to be bigger than conveying force by giving side's conveying means at delivery area where developer is delivered between said first conveying means and said second conveying means.

15. A developing device according to claim 14, wherein said second conveying means is arranged above said first conveying means, conveying force by said second conveying means is made to be greater than conveying force by said first conveying means at carry-up area where developer is carried up from said first conveying means to said second conveying means.

16. A developing device according to claim 15, wherein rotating speed of said second conveying means is faster than that of said first conveying means.

17. A developing device according to claim 14, wherein said first conveying means and said second conveying means correspond to a first screw and a second screw, respectively.

18. A developing device according to claim 17, wherein effective conveying area of second screw's screw blade is larger than that of said first screw's at said delivery area.

19. A developing device according to claim 18, wherein outer diameter of said second screw's screw blade is larger than that of said first screw's at said delivery area.

20. A developing device according to claim 18, wherein center angle of said second screw's screw blade is larger than that of said first screw's at said delivery area.

21. A developing device according to claim 18, wherein shaft diameter of said second screw's screw blade is smaller than that of said first screw's at said delivery area.

22. A developing device according to claim 18, wherein notch of said second screw's screw blade is smaller than that of said first screw's at said delivery area.

23. A developing device according to claim 17, wherein pitch of said second screw's screw blade is larger than that of said first screw's at said delivery area.

24. A developing device according to claim 17, wherein the number of threads of said second screw's screw blade is larger than that of said first screw's at said delivery area.

25. A developing device according to claim 17, wherein screw blade for said first screw is arranged parallel to the axis penetrating said first screw at said delivery area.

26. A developing device according to claim 17, wherein only said second screw has a screw blade at said delivery area.

27. A developing device comprising:

a developing roll;

a supply screw which conveys developer in axial direction to supply said developer for said developing roll;

a collection screw which collects developer left on said developing roll and conveys said developer in axial direction; and an agitating screw which agitates developer and conveys said developer in axial direction; wherein said collection screw is arranged below said supply screw and said agitating screw is arranged above said supply screw, conveying force by upper screw is made to be larger than conveying force by lower screw within at least one of first carry-up area and second carry-up area, said first carry-up area where developer is carried up to said supply screw from said collection screw, said second carry-up area where developer is carried up to said agitating screw from said supply screw, and said first carry-up area is arranged at far more downstream side for said collection screw's conveying direction than at said second carry up area.

28. A developing device comprising:

a first screw and a second screw to convey developer in axial direction; and delivery area where developer is delivered to said second screw from said first screw or vice versa, wherein larger diameter screw blade part is applied to said delivery area for at least one of said first screw and said second screw.

29. A developing device according to claim 28, wherein both said first screw and second screw have at least single part of larger diameter screw blade within said delivery area, said larger diameter parts for both screws overlap in axial direction.

30. A developing device according to claim 28, wherein said second screw is arranged above said first screw, said delivery area is carry-up area where developer is carried up from said first screw to said second screw.

31. A developing device comprising:

a developer storage tank; and a first screw and a second screw both arranged inside of said developer storage tank to convey developer; wherein delivery area where developer is delivered from said second screw to said first screw or vice versa is arranged at downstream for conveying direction of giving side's screw, and inner surface of said developer storage tank is curved surface at said delivery area.

32. A developing device according to claim 31, wherein said second screw is arranged above said first screw, and said delivery area is carry-up area where developer is carried up from said first screw to said second screw.

33. A developing device comprising:

a developer storage tank; and a first screw and a second screw both arranged inside of said developer storage tank to convey developer; wherein delivery area where developer is delivered from said first screw to said second screw or vice versa is arranged at downstream of conveying direction for giving side's screw, and inner surface of said developer storage tank is tapered surface at said delivery area.

34. A developing device according to claim 33, wherein said second screw is arranged above said first screw, and said delivery area is carry-up area where developer is carried up to said second screw from said first screw.

35. A developing device comprising:

a developer storage tank; and a first screw and a second screw both arranged inside of said developer storage tank to convey developer; wherein delivery area where developer is delivered from said first screw to said second screw or vice versa is applied at downstream of conveying direction for giving side's screw, and conveying force by said giving side's screw is made to be smaller at said delivery area than other area.

36. A developing device according to claim 35, wherein effective conveying area of a screw blade for said giving side is smaller at said delivery area than at other area.

37. A developing device according to claim 36, wherein outer diameter of a screw blade for said giving side is smaller at said delivery area than at other area.

38. A developing device according to claim 35, wherein said second screw is arranged above said first screw, and said delivery area is carry-up area where developer is carried up to said second screw from said first screw.

* * * * *